US009716348B2

(12) United States Patent
Spiel

(10) Patent No.: US 9,716,348 B2
(45) Date of Patent: Jul. 25, 2017

(54) CONNECTOR FOR A UNIFIED POWER AND DATA CABLE

(71) Applicant: Cisco Technology, Inc., San Jose, CA (US)

(72) Inventor: Seth Brandon Spiel, San Francisco, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 14/975,429

(22) Filed: Dec. 18, 2015

(65) Prior Publication Data

US 2017/0179650 A1 Jun. 22, 2017

(51) Int. Cl.
*H01R 13/648* (2006.01)
*H01R 13/6585* (2011.01)
*H01R 13/66* (2006.01)

(52) U.S. Cl.
CPC ..... *H01R 13/6585* (2013.01); *H01R 13/665* (2013.01)

(58) Field of Classification Search
CPC ..... H01R 13/6585
USPC ..... 439/607.05, 607
See application file for complete search history.

(56) References Cited

U.S. PATENT DOCUMENTS 2,180,731 A * 11/1939 Dickinson ..... H01B 9/003 174/105 B
3,023,267 A * 2/1962 Eager, Jr. ..... H01B 7/00 174/113 R
4,250,351 A * 2/1981 Bridges ..... H01B 7/04 174/106 R
4,941,845 A 7/1990 Eppley et al.
5,444,184 A * 8/1995 Hassel ..... H01B 9/003 174/113 C
5,557,698 A * 9/1996 Gareis ..... H01B 11/1891 385/100
5,683,263 A 11/1997 Hsu
6,533,466 B1 * 3/2003 Smith ..... G02B 6/3817 385/60
6,855,881 B2 * 2/2005 Khoshnood ..... G02B 6/3817 174/15.1
7,591,673 B2 9/2009 Chan et al.
7,740,501 B2 * 6/2010 Ballard ..... H01B 9/003 174/105 R
8,177,560 B2 * 5/2012 Rohrbach ..... H01R 13/6205 439/39

(Continued)

*Primary Examiner* — Tulsidas C Patel
*Assistant Examiner* — Peter G Leigh
(74) *Attorney, Agent, or Firm* — Ronald S. Fernando

(57) ABSTRACT

In one implementation, a device includes: one or more data terminals, where each of the one or more data terminals provides a respective mating interface between a respective data transmission path and a corresponding device data port; a first power terminal having a power portion and a ground portion separated by a dielectric, where the ground portion is arranged in association with the one or more data terminals in order to shield the one or more data terminals from electromagnetic interference from the power portion, and where the first power terminal provides a respective mating interface between a respective power transmission path and a corresponding device power port; and a support member provided to maintain the arrangement of the one or more data terminals in combination with the first power terminal.

20 Claims, 13 Drawing Sheets

(56) References Cited

U.S. PATENT DOCUMENTS

| | | | | |
|---|---|---|---|---|
| 8,230,115 | B2 | 7/2012 | Lee | |
| 8,414,319 | B2 | 4/2013 | Patel et al. | |
| 9,018,529 | B2 * | 4/2015 | Sidlyarevich | H01B 7/04 174/110 R |
| 9,112,304 | B2 * | 8/2015 | Rohrbach | H01R 13/6205 |
| 9,190,744 | B2 | 11/2015 | Burris | |
| 9,515,439 | B2 * | 12/2016 | Ng | H01R 24/70 |
| 2001/0038294 | A1 * | 11/2001 | Matsunaga | G01R 1/06738 29/828 |
| 2004/0200631 | A1 | 10/2004 | Chen | |
| 2009/0011639 | A1 * | 1/2009 | Ballard | H01B 9/003 439/607.01 |
| 2011/0008980 | A1 * | 1/2011 | Obata | G11B 33/025 439/131 |
| 2014/0073185 | A1 * | 3/2014 | Siahaan | H01R 13/504 439/607.58 |
| 2014/0170907 | A1 * | 6/2014 | Golko | H01R 13/516 439/676 |
| 2014/0206209 | A1 | 7/2014 | Kamei et al. | |
| 2015/0034381 | A1 * | 2/2015 | Harwath | H01B 7/0823 174/70 R |
| 2016/0141822 | A1 * | 5/2016 | Hijazi | H01R 13/6595 361/679.31 |
| 2016/0217884 | A1 * | 7/2016 | Harwath | H01B 7/0018 |

* cited by examiner

CONNECTOR FOR A UNIFIED POWER AND DATA CABLE

TECHNICAL FIELD

The present disclosure relates generally to managing connectivity of networking equipment, and in particular, to connectors for terminating a cable that handles both power and data transmission.

BACKGROUND

The ongoing development and expansion of data networks often involves balancing scalability and modularity of networking equipment against ease of connectivity and preferable form factors. For example, for larger-scale enterprise infrastructure deployments, a number of network switches are often incorporated into a single network switching chassis that has a relatively compact form factor and reduces the number of cables between the network switches by using a shared backplane. However, deployment of a network switching chassis often involves a significant upfront capital expense. Moreover, a network switching chassis provides a relatively large amount of functional capacity that may not be fully utilized for a particular deployment, even if demand is projected to grow.

For smaller and more scalable deployment demands, a number of network switches are often connected in a stacked arrangement. The stacked arrangement provides enhanced scalability and modularity as compared to the aforementioned single network switching chassis. The stacked arrangement often involves a smaller upfront capital expense, and allows capital expenses to be distributed over time in response to demand for network growth. However, there are a number of problems with the stacked arrangement. As the stacked arrangement grows, separate data stacking cables are used to enable high speed switching of packet traffic between network switches. Furthermore, separate power stacking cables are used to enable high power redundancy between network switches. A stacked arrangement with four network switches, for example, uses four data stacking cables and four power stacking cables to connect the network switches in a ring topology.

The separate data stacking and power stacking cables are both expensive and cumbersome. Furthermore, the number of cables used to connect the network switches in a stacked arrangement leads to installation errors, which, in turn, causes degradation of network up-time and performance.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Figure 1:
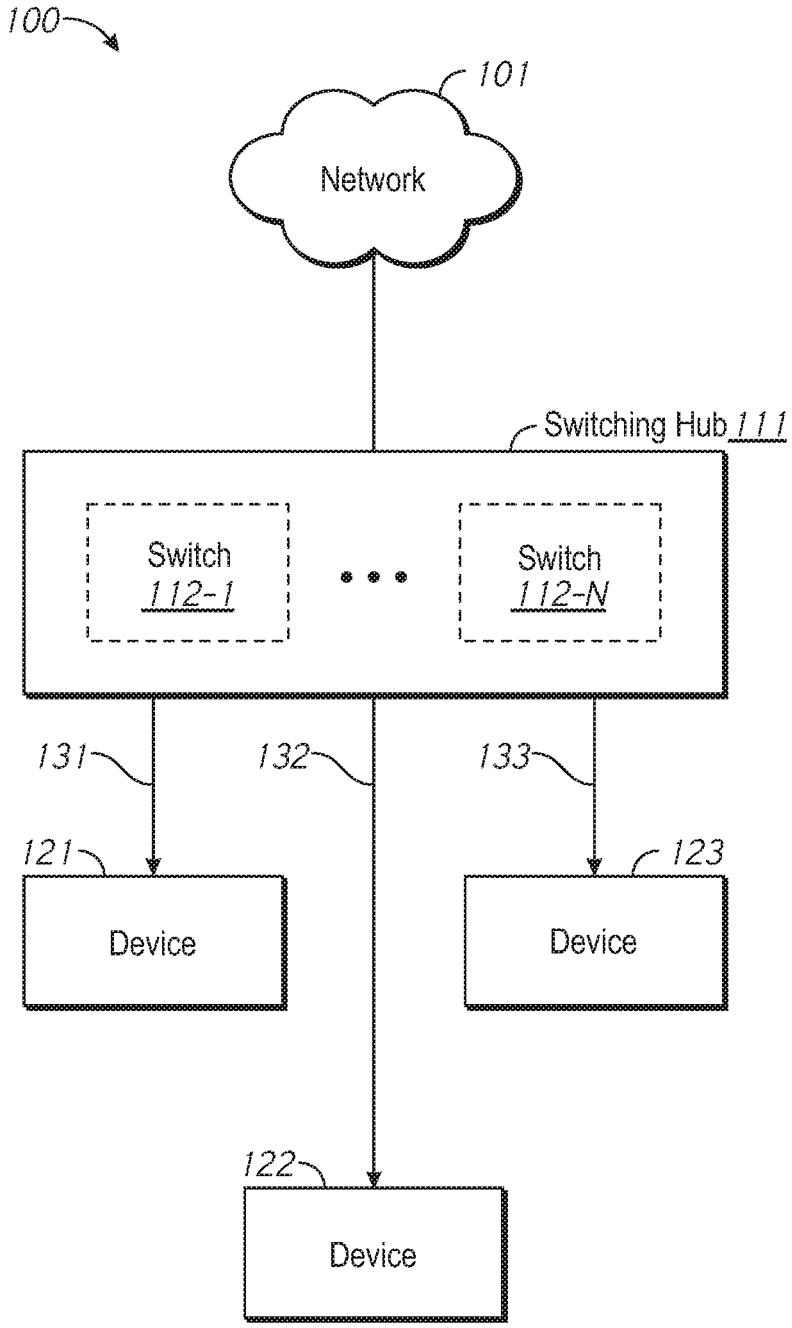
FIG. 1 is a block diagram of a data network in accordance with some implementations.

In accordance with common practice various features shown in the drawings may not be drawn to scale, as the dimensions of various features may be arbitrarily expanded or reduced for clarity. Moreover, the drawings may not depict all of the aspects and/or variants of a given system, method or apparatus admitted by the specification. Finally, like reference numerals are used to denote like features throughout the figures.

DESCRIPTION OF EXAMPLE EMBODIMENTS

Numerous details are described herein in order to provide a thorough understanding of the illustrative implementations shown in the accompanying drawings. However, the accompanying drawings merely show some example aspects of the present disclosure and are therefore not to be considered limiting. Those of ordinary skill in the art will appreciate from the present disclosure that other effective aspects and/or variants do not include all of the specific details of the example implementations described herein. While pertinent features are shown and described, those of ordinary skill in the art will appreciate from the present disclosure that various other features, including well-known systems, methods, components, devices, and circuits, have not been illustrated or described in exhaustive detail for the sake of brevity and so as not to obscure more pertinent aspects of the example implementations disclosed herein.

Overview

Various implementations disclosed herein include methods, devices, apparatuses, and systems for enabling power and data transmission between two or more devices with a unified power and data cable. For example, in some implementations, a device (e.g., a connector terminating an end of a unified power and data cable) includes one or more data terminals, where each of the one or more data terminals provides a respective mating interface between a respective data transmission path and a corresponding device data port. The device also includes a first power terminal having a power portion and a ground portion separated by a dielectric portion, where the ground portion is arranged in association with the one or more data terminals in order to shield the one or more data terminals from electromagnetic interference from the power portion, and where the first power terminal provides a respective mating interface between a respective power transmission path and a corresponding device power port. The device further includes a support member provided to maintain the arrangement of the one or more data terminals in combination with the first power terminal.

EXAMPLE EMBODIMENTS

Figure 2A:
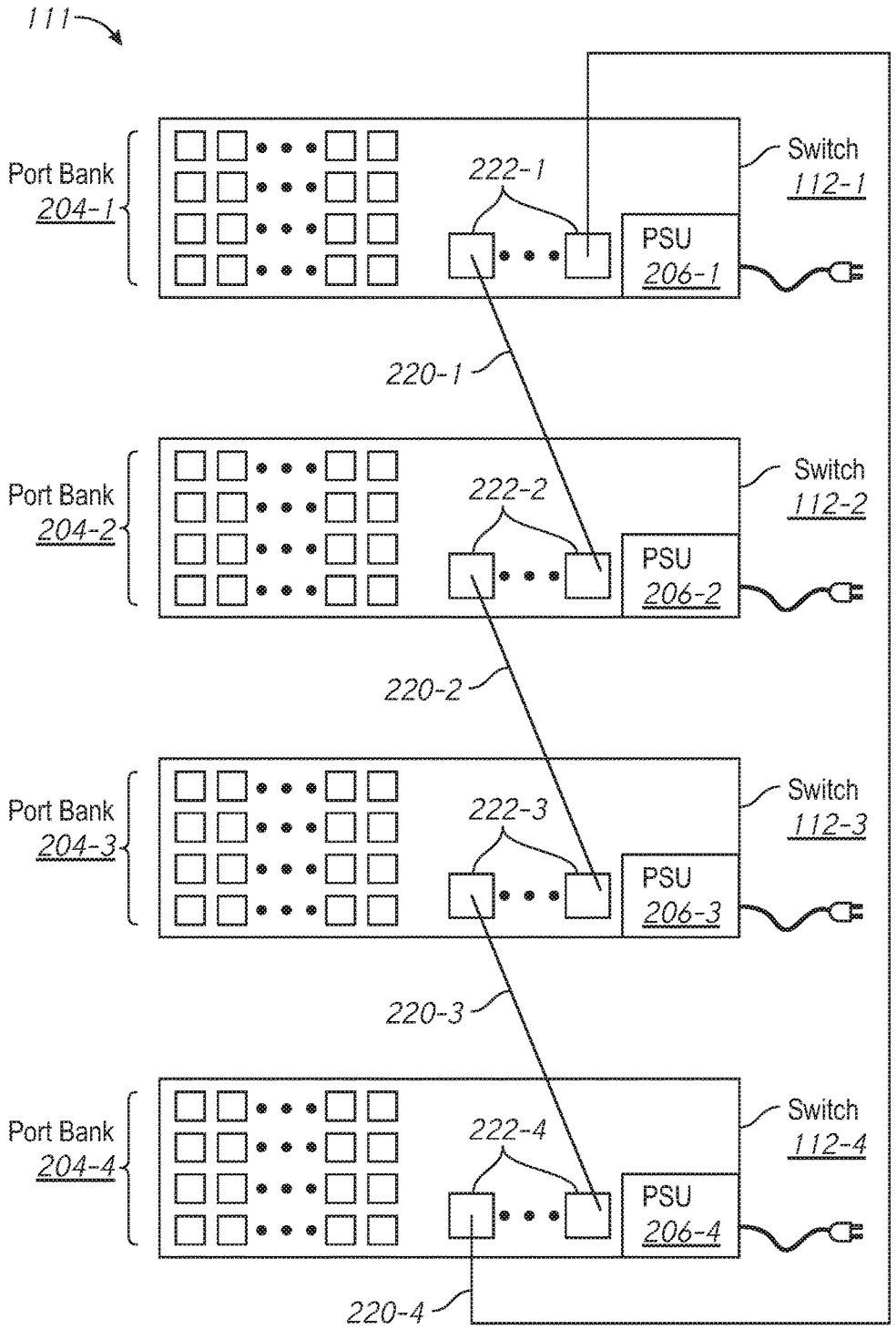
FIG. 2A is a block diagram of an interconnected stack of switches in accordance with some implementations.

In some implementations, a plurality of network switches is provided in a stacked arrangement (e.g., as shown in FIG. 2A). The plurality of network switches is connected according to various topologies (e.g., ring, star, mesh, etc.) with unified power and data cables. A unified power and data cable includes both a data transmission path provided to support high frequency packet traffic between two network devices and a power transmission path provided to support power connection redundancy between the same two network devices, which sheathes the data transmission path. The use of unified power and data cables not only reduces infrastructure costs related to the stacked arrangement but also reduces the potential for human error during installation because a lesser number of cables are used. Additionally, combining the power and data into a single cable prevents the operator from splitting power and data redundancy. When power and redundancy are split, additional unrecoverable failures modes are introduced, which contradicts the purpose of redundant stacking.

In a stacked arrangement of network switches (or other network devices), the respective ports of one switch are coupled to adjacent switches in the stack in order to form a chained data path or data path ring using unified power and data cables. Similarly, the respective power port of one switch is coupled to adjacent switches in the stack in order to form a chained power path or power path ring using the same unified power and data cables. In such an arrangement, if a first network switch fails, power and data is re-routed through adjacent switches in the stack so that the stack as a whole merely operates at reduced capacity and does not fail altogether. Electromagnetic interference (e.g., a noise spike) is produced by the instantaneous change in current when the adjacent network switches deliver power to the failed, first network switch over the power transmission paths of the unified power and data cables. In some implementations, ground layer of the power transmission path is located between the power transmission path and the data transmission path of the unified power and data cable to shield packet traffic on the data transmission path from the aforementioned electromagnetic interference.

Furthermore, in some implementations, the unified power and data cable is terminated by connectors having one or more data terminals that provide a mating interface between the data transmission path and a device data port and one or more power terminals that provide a mating interface between the power transmission path and a device power port. In some implementations, the one or more power terminals are arranged in association with the one or more data terminals in order to shield the one or more data terminals from the aforementioned electromagnetic interference.

FIG. 1 is a block diagram of a data network 100 in accordance with some implementations. The data network 100 includes an interconnected stack of switches 111 that couples a number of devices 121-123 to a network 101. The network 101 may include any public or private LAN (local area network) and/or WAN (wide area network), such as an intranet, an extranet, a virtual private network, and/or portions of the Internet. In some implementations, one or more of the devices 121-123 are client devices including hardware and software for performing one or more functions. Example client devices include, without limitation, network routers, switches, wireless access points, IP (Internet protocol) cameras, VoIP (voice over IP) phones, intercoms and public address systems, clocks, sensors, access controllers (e.g., keycard readers), lighting controllers, etc. In some implementations, one or more of the devices 121-123 are virtual devices that consume power through the use of underlying hardware.

The interconnected stack of switches 111 (which may also be referred to as a switching hub, network switch, a bridging hub, a MAC (media access control) bridge, or a combination of multiple components thereof) receives and transmits data between the network 101 and the devices 121-123. In some implementations, the interconnected stack of switches 111 manages the flow of data of the data network 100 by transmitting messages received from the network 101 to the devices 121-123 for which the messages are intended. In some implementations, each of the devices 121-123 coupled to the interconnected stack of switches 111 is identified by a MAC address, allowing the interconnected stack of switches 111 to regulate the flow of traffic through the data network 100 and also to increase the security and efficiency of the data network 100. In some implementations, the interconnected stack of switches 111 includes a plurality of network switches 112-1, . . . , 112-N each of which are coupled to one or more of the devices 121-123.

The interconnected stack of switches 111 is communicatively coupled to each of the devices 121-123 via respective transmission media 131-133, which may be wired or wireless. In some implementations, the interconnected stack of switches 111, in addition to receiving and transmitting data via the transmission media 131-133, provides power to the devices 121-123 via the transmission media 131-133. For example, in some implementations, the interconnected stack of switches 111 is coupled to the devices 121-123 via an Ethernet cable.

In some implementations, the interconnected stack of switches 111 or component(s) thereof (e.g., network switches 112-1, . . . , 112-N) provide power to the devices 121-123 via an Ethernet cable according to a Power-over-Ethernet (PoE) standard. For example, the interconnected stack of switches 111 provides power to the devices 121-123 according to the Institute of Electrical and Electronics Engineers (IEEE) 802.3af standard. Continuing with this example, the interconnected stack of switches 111 outputs 15.4 W (watts) of power to each of the devices 121-123. In other examples, the interconnected stack of switches 111 provides power to the devices 121-123 according to other standards such as IEEE 802.3at, IEEE 802.3az, IEEE 802.3bt, or the like. In some implementations, the interconnected stack of switches 111 or component(s) thereof (e.g., network switches 112-1, . . . , 112-N) provide power to the devices 121-123 via other types of transmission media 131-133 such as a Universal Serial Bus (USB) cable or the like.

FIG. 2A is a block diagram of the interconnected stack of switches 111 in accordance with some implementations. For ease of discussion, the interconnected stack of switches 111 in FIG. 2A comprises network switches 112-1, 112-2, 112-3, and 112-4 implemented in a stacked arrangement. In some implementations, one of ordinary skill in the art will appreciate that the interconnected stack of switches 111 comprises an arbitrary number of network switches or similar network devices. In some implementations, each of the network switches 112 includes: a port bank 204; two or more inter-switch ports 222; and a power supply unit (PSU) 206.

Port bank 204-1 of representative network switch 112-1 includes a plurality of ports (e.g., 24, 48, etc.) for connecting the network switch 112-1 with one or more of the devices 121-123. For example, the network switch 112-1 is coupled with one or more of the devices 121-123 via Ethernet cables connected to the ports of the port bank 204-1 (not shown). In some implementations, all of the ports of the port bank 204-1 are alike (e.g., Ethernet ports). In some implementations, the port bank 204-1 includes at least two types of ports (e.g., both Ethernet and USB ports).

In some implementations, the network switches 112 are interconnected in a ring topology, as shown in FIG. 2A, using unified power and data cables 220-1, 220-2, 220-3, and 220-4. In some implementations, one of ordinary skill in the art will appreciate that the network switches 112 are coupled according to various other topologies, such as a star topology or a mesh/fully-connected topology, using a same or a different number of unified power and data cables. For example, the network switch 112-1 is coupled to network switch 112-2 via cable 220-1, which is connected to one of inter-switch ports 222-1, and also to network switch 112-4 via cable 220-4, which is connected to a different one of inter-switch ports 222-1. In this example, the cable 220-1 has a first connector (not shown) terminating a first end of the cable 220-1 that is connected to one of inter-switch ports 222-1 of the network switch 112-1 and a second connector (not shown) terminating a second end of the cable 220-1 that is connected to one of inter-switch ports 222-2 of the network switch 112-2. In some implementations, each of the inter-switch ports 222 has a device power port portion for receiving and delivering power data and a device data port portion for receiving and transmitting data.

In some implementations, the cables 220 are unified power and data cables that enable high frequency packet traffic between network switches 112 and also enable redundant power between networks switches 112. For example, if PSU 206-1 of the network switch 112-1 fails, the network switch 112-1 sinks power from network switch 112-2 via the cable 220-1 and/or from network switch 112-4 via the cable 220-4. Furthermore, network switches 112-2 and 112-4 route data traffic to the network switch 112-1 via cables 220-1 and 220-4, respectively.

In one example, if 48 devices are connected to the 48 ports of port bank 204-1 of the network switch 112-1 and all of the devices are sourcing power from the network switch 112-1 according to IEEE 802.3at (e.g., approximately 30 W each), at least one of the network switch 112-2 and the network switch 112-4 provides a total power supply boost of approximately 1.5 kW to the devices connected to the port bank 204-1 when the network switch 112-1 fails.

In some implementations, PSUs 206 operate at a switching frequency between 500 kHz and 5 MHz. In those implementations, the network switches 112-2 and 112-4 are limited to delivering power at these speeds, leaving a power supply gap between the failure of the network switch 112-1 and a subsequent power boost from network switches 112-2 and/or 112-4 according to the switching frequency of PSUs 206-2 and 206-4, respectively. To account for this power supply gap, at least a portion of each of the cables 220 act as a distributed capacitance path that store charge to supply current to a failed network switch and/or the device connected to the failed network switch during the power supply gap.

Figure 2B:
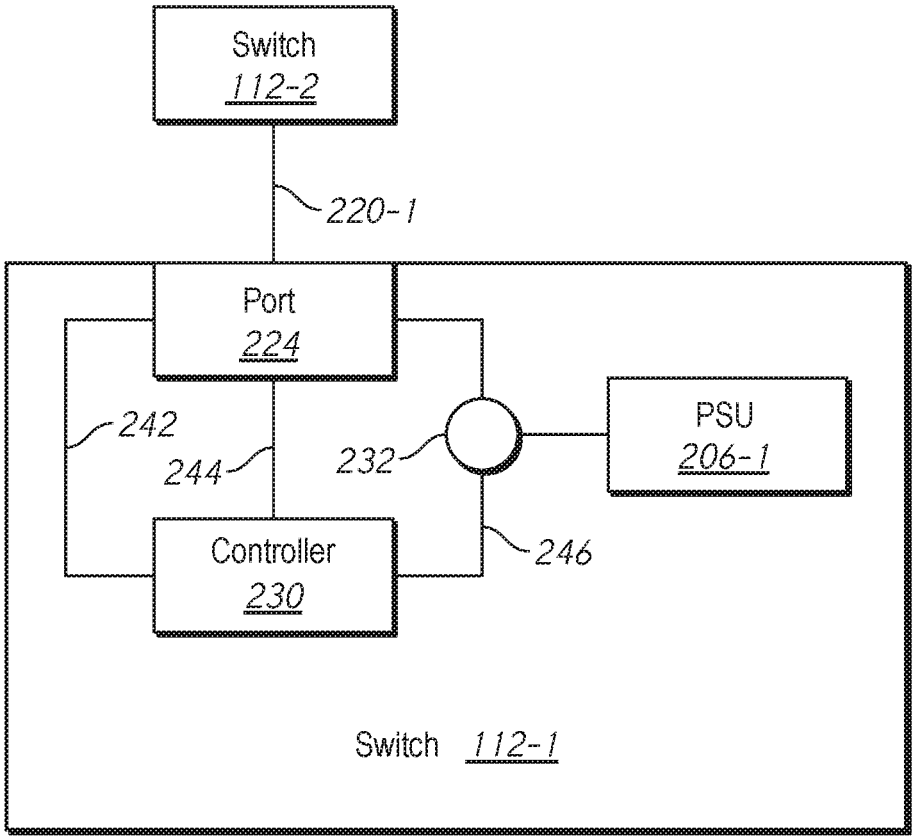
FIG. 2B is a block diagram of a networking switch in accordance with some implementations.

FIG. 2B is a block diagram of a representative network switch 112-1 in accordance with some implementations. As shown in FIG. 2B, the network switch 112-1 is at least coupled to networking switch 112-2 via cable 220-1, which is connected to port 224 (e.g., one of the inter-switch ports 222-1 shown in FIG. 2A). In some implementations, the network switch 112-1 includes a controller 230 configured to authenticate the cable 220-1 and to enable the cable 220-1 to deliver power to the network switch 112-1 and/or the network switch 112-2.

In some implementations, the controller 230 drives a low-speed data interface coupled to the port 224 via line 242 and a high-speed data interface coupled to the port 224 via line 244. In some implementations, the controller 230 drives the low-speed and high-speed data interfaces via a same line. In some implementations, the controller 230 polls the port 224 (e.g., with the low-speed interface) to determine whether the cable 220-1 is coupled with the port 224. In some implementations, after detecting the cable 220-1, the controller 230 authenticates the cable 220-1 using the low-speed interface. In some implementations, as part of the polling process, the controller 230 authenticates the cable 220-1 using the low-speed interface. For example, the cable 220-1 is authenticated if it is manufactured by or associated with a predefined manufacturer or distributer. In another example, the cable 220-1 is authenticated if its serial number satisfies predefined criteria.

In some implementations, the controller 230 determines whether the cable 220-1 is coupled with the networking switch 112-2 and determines whether the networking switch 112-2 is a compatible device using the high-speed data interface. In some implementations, the controller 230 determines whether the cable 220-1 is coupled with the networking switch 112-2 and determines whether the networking switch 112-2 is a compatible device by accessing cloud-based data. For example, the cloud-based data indicates that the networking switch 112-2 is coupled with a cable that has a same serial number (e.g., the cable 220-1).

In some implementations, the controller 230 is coupled with a logic controlled switch 232 via control line 246. As shown in FIG. 2B, the logic activated switch 232 is coupled with the PSU 206-1. In some implementations, the logic activated switch 232 is configured to control the delivery of power from power supply unit PSU 206-1. The controller 230 activates the logic controlled switch 232 in order to enable the PSU 206-1 to deliver power to the networking switch 112-2 via the cable 220-1 in response to authenticating the cable 220-1 and determining that the cable 220-1 is coupled with the networking switch 112-2. In some implementations, the controller 230 is configured to send an enable instruction to the cable 220-1 in order to enable the delivery of power to and/or from the network switch 112-1 in response to authenticating the cable 220-1 and determining that the cable 220-1 is coupled with the networking switch 112-2. The detection and authentication process is discussed in more detail with reference to FIG. 11.

Figure 3A:
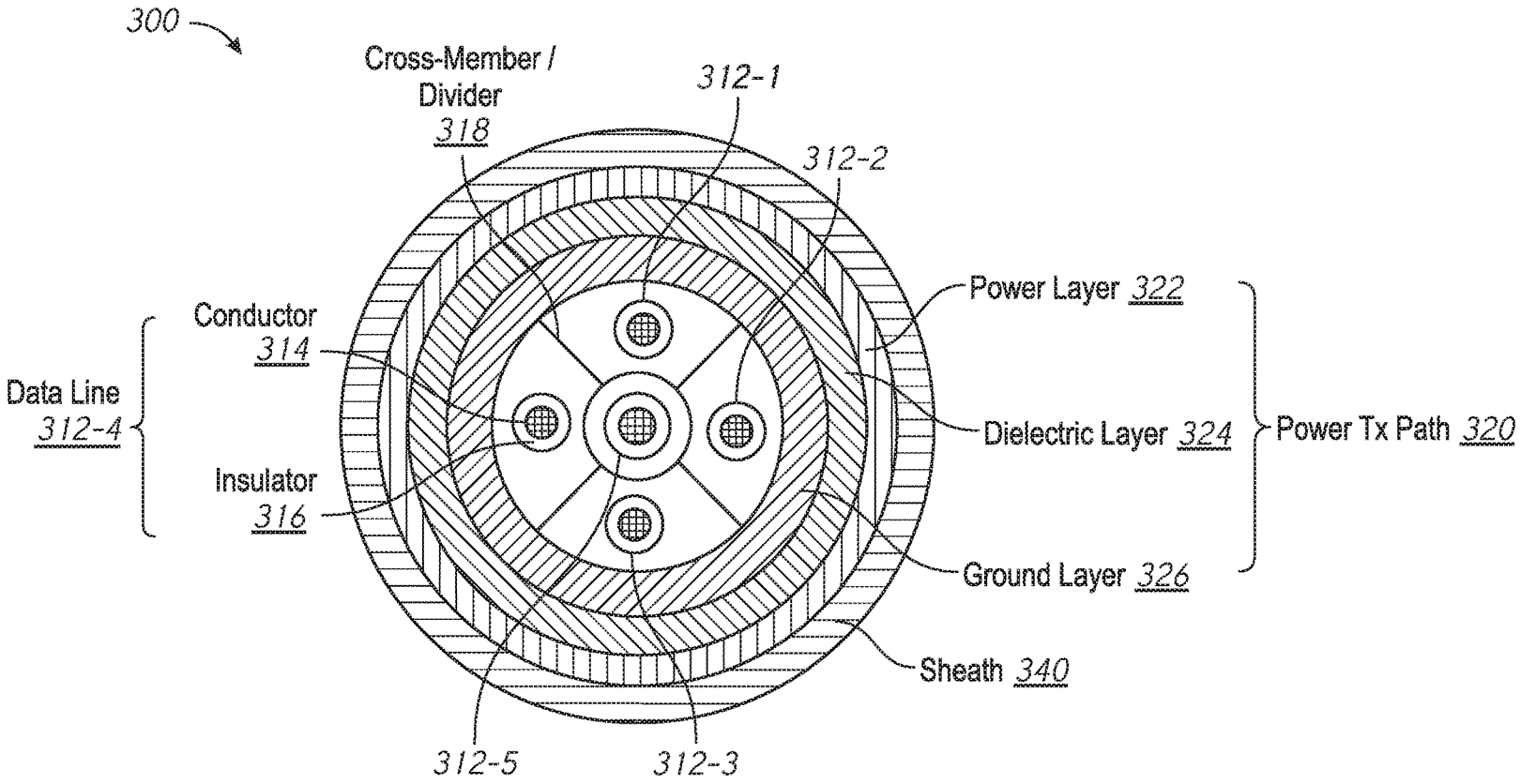
FIG. 3A is a cross-section view of a unified power and data cable in accordance with some implementations.

FIG. 3A is a cross-section view of a unified power and data cable 300 in accordance with some implementations. For example, the unified power and data cable 300 is one of the cables 220 in FIG. 2A. In some implementations, the unified power and data cable 300 comprises: a data transmission path with a plurality of data lines 312; a power transmission path 320 that sheathes the data transmission path; and a sheath 340 that sheathes the power transmission path 320.

In FIG. 3A, the data transmission path includes data lines 312-1, 312-2, 312-3, 312-4, and 312-5 that extend along the longitudinal axis of the unified power and data cable 300. In some implementations, one of ordinary skill in the art will appreciate that the data transmission path comprises an arbitrary number of data lines. Representative data line 312-4 includes a conductor 314 that is sheathed by an insulator 316. In some implementations, the data lines 312 are differential pairs, twisted pairs, or the like. In some implementations, the data transmission path also includes a cross-member/divider 318 to shield and separate the plurality of data lines 312 as shown in FIG. 3A. In some implementations, the number of compartments forming and the geometry of the cross-member/divider 318 are determined by the number of data lines 312 in the data transmission path.

In FIG. 3A, the power transmission path 320 comprises: a power layer 322; a dielectric layer 324; and a ground layer 326. With reference to the power transmission path 320, the dielectric layer 324 is located between the power layer 322 and the ground layer 326. With reference to FIG. 3A, the power layer 322 sheathes the ground layer 326. As such, the ground layer 326 shields the data transmission path from electromagnetic interference caused by the power layer 322.

In some implementations, the power layer 322 acts as a current source path from a power source (e.g., a network switch providing a power boost to a failed network switch and/or the device(s) connected to the failed network switch) to a load (e.g., the failed network switch and/or the device(s) connected to the failed network switch), and the ground layer 326 acts as a current return path from the load to the power source. In some implementations, the ground layer 326 also acts as a return path for the one or more data lines 312 of the data transmission path.

The power transmission path 320 forms a distributed impedance path that extends along the longitudinal axis of the unified power and data cable 300. As such, the transmission path 320 stores charge so as to supply current during the power supply gap between when a network switch fails and the PSU of a connected network switch provides a power boost according to the PSU's switching frequency.

In some implementations, the power transmission path 320 is a distributed impedance path with at least one frequency dependent impedance characteristic. In some implementations, the frequency dependent impedance characteristic of the power transmission path 320 is characterized by a capacitance value that satisfies a capacitance criterion at frequencies above (or below) a first frequency level. For example, when a high frequency event at frequencies above a first frequency level occurs (e.g., frequencies greater than 100 MHz), such as powering on a network switch or delivering power to a failed/disabled network switch, the capacitance value of the power transmission path 320 is greater than a threshold capacitance value (e.g., between 1 nF and 100 nF).

In some implementations, the frequency dependent impedance characteristic of the power transmission path 320 is characterized by an inductance value that satisfies a first inductance criterion at frequencies above a first frequency level. For example, when a high frequency event at frequencies above a first frequency level occurs (e.g., frequencies greater than 100 MHz), such as powering on a network switch or delivering power to a failed/disabled network switch, the inductance value of the power transmission path 320 at a particular frequency or frequencies is less than a threshold inductance value (e.g., 10 nH).

In some implementations, the frequency dependent impedance characteristic of the power transmission path 320 is characterized by an inductance value that satisfies a second inductance criterion at frequencies below a second frequency level. For example, at frequencies lower than 60 Hz, such as DC operation, the inductance value of the power transmission path 320 is less than a threshold inductance value (e.g., 10 nH).

Figure 3B:
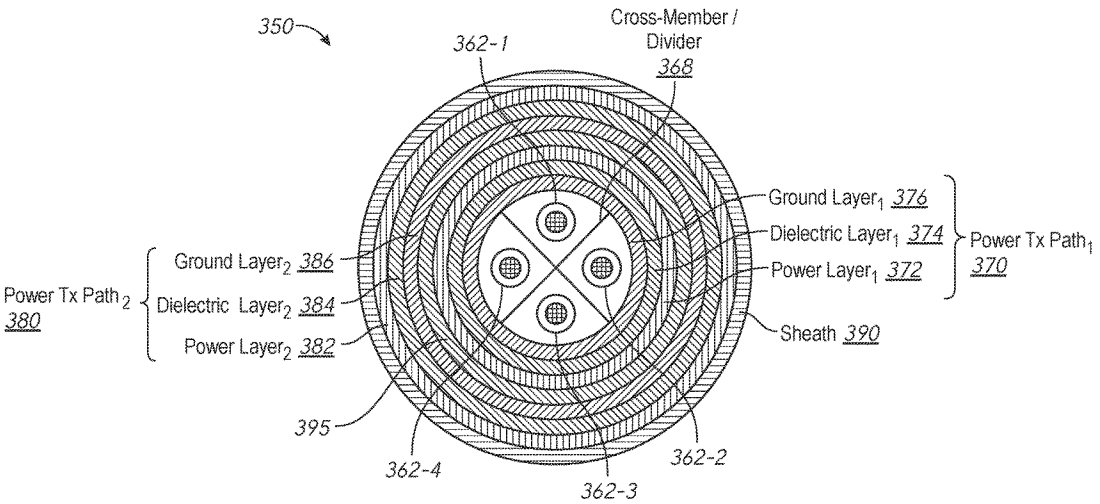
FIG. 3B is another cross-section view of a unified power and data cable in accordance with some implementations.

FIG. 3B is another cross-section view of a unified power and data cable 350 in accordance with some implementations. For example, the unified power and data cable 350 is one of the cables 220 in FIG. 2A. In some implementations, the unified power and data cable 350 comprises: a data transmission path with a plurality of data lines 362; a first power transmission path 370 that sheathes the data transmission path; a second power transmission path 380 that sheathes the first power transmission path 370; and a sheath 390 that sheathes the second power transmission path 380.

In FIG. 3B, the data transmission path includes data lines 362-1, 362-2, 362-3, and 362-4 that extend along the longitudinal axis of the unified power and data cable 350. In some implementations, one of ordinary skill in the art will appreciate that the data transmission path comprises an arbitrary number of data lines. In some implementations, the data lines 362 are differential pairs, twisted pairs, or the like. In some implementations, the data transmission path also includes a cross-member/divider 368 to shield and separate the plurality of data lines 362 as shown in FIG. 3B. In some implementations, the number of compartments forming and the geometry of the cross-member/divider 368 are determined by the number of data lines 362 in the data transmission path.

Similar to the power transmission path 320 in FIG. 3A, the first power transmission path 370 comprises: a power layer 372; a dielectric layer 374; and a ground layer 376. Moreover, also similar to the power transmission path 320 in FIG. 3A, the second power transmission path 380 comprises: a power layer 382; a dielectric layer 384; and a ground layer 386. In some implementations, the aforementioned components of the first power transmission path 370 and the second power transmission path 380 are adapted from those discussed above with reference to the power transmission path 320 in FIG. 3A and are not described again in detail for the sake of brevity.

With reference to FIG. 3B, a dielectric layer 395 is located between the first power transmission path 370 and the second power transmission path 380. Although the unified power and data cable 350 includes two power transmission paths, one of ordinary skill in the art will appreciate that the unified power and data cable 350 comprises an arbitrary number of power transmission paths. As such, in some implementations, additional power transmission paths are added to the unified power and data cable for a modularly expansive current carrying capacity and a capacitance value that suits particular needs.

Figure 4:
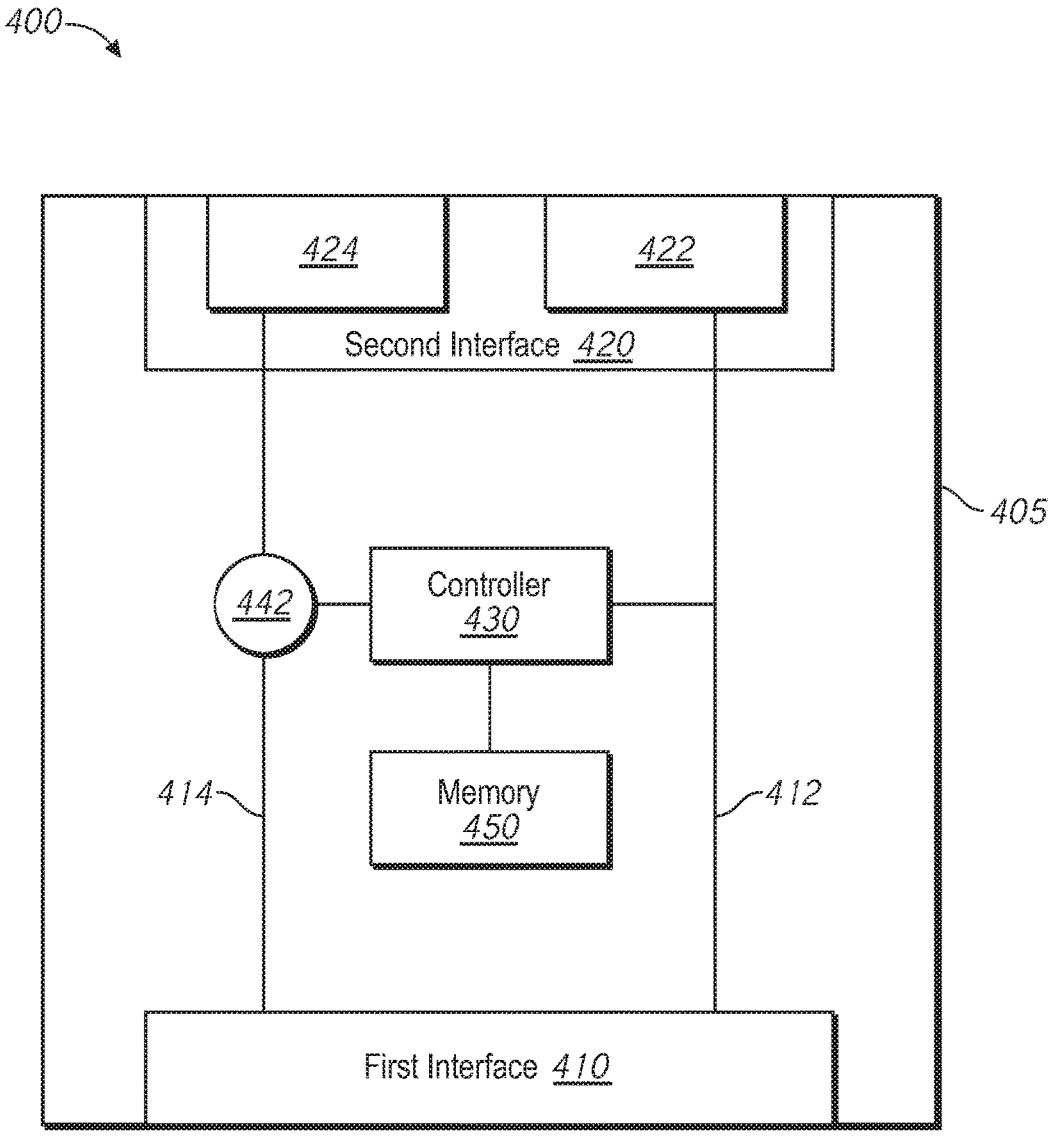
FIG. 4 is a block diagram of a connector for a unified power and data cable in accordance with some implementations.

FIG. 4 is a block diagram of a connector 400 for the unified power and data cable in accordance with some implementations. In some implementations, the components of the connector 400 are at least partially enclosed within a housing 405. As shown in FIG. 4, the connector 400 includes a first interface 410 (sometimes also herein called a "receiving interface" or a "translating interface") configured to receive a respective end of a unified power and data cable (e.g., one of the cables 220 in FIG. 2A) having a data transmission path (e.g., with one or more data lines) and at least one power transmission path sheathing the data transmission path. The first interface 410 is also configured to translate the geometry of the unified power and data cable (e.g., circular layers) to the geometry of the second interface 420 (e.g., the geometry of the mating interface in FIG. 5A, 5B, 5C, 6A, or 6B). The connector 400 also includes a second interface 420 (sometimes also herein called a "mating interface") connectable to a port of a device (e.g., one of the inter-switch ports 222 of the networking devices 112 in FIG. 2A).

In some implementations, the second interface 420 includes: one or more data terminals 422 that each provide a respective mating interface between a data line of the data transmission path 412 and a device data port; and one or more power terminals 424 that each provide a respective mating interface between the at least one power transmission path 414 and a corresponding device power port. In some implementations, the first interface 410 receives the unified power and data cable and separates the data transmission path 412 from the power transmission path 414 in order to couple the data transmission path 412 to the one or more data terminals 422 and the power transmission path 414 to the one or more power terminals 424.

In some implementations, the connector 400 optionally includes a controller 430 coupled to the data transmission path 412 and the power transmission path 414. In some implementations, the controller 430 drives a low-speed data interface in order to authenticate the unified power and data cable. In some implementations, the controller 430 drives a high-speed data interface for determining whether a device is coupled to a far end of the unified power and data cable and whether said device is a compatible device. In some implementations, the controller 430 is coupled with a logic controlled switch 442. As shown in FIG. 4, the logic activated switch 442 is configured to control the delivery of power to and from the device power port coupled to the one or more power terminals 424. The controller 430 activates the logic controlled switch 442 in order to enable the delivery of power to and from the device power port coupled to the one or more power terminals 424 in response to authenticating the unified power and data cable and determining that the unified power and data cable is coupled with a device at its far end. In some implementations, the connector 400 also includes memory 450 storing information, such as manufacturing date, a manufacturer, a serial number, specifications, tolerances, and the like, for authenticating the unified power and data cable.

Figure 5A:
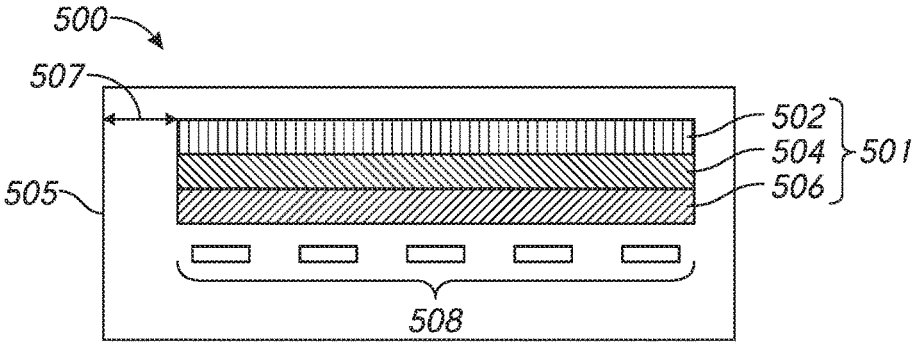
FIG. 5A is an end view of a mating interface of a connector for a unified power and data cable in accordance with some implementations.

FIG. 5A is an end view of a mating interface of a connector 500 for a unified power and data cable in accordance with some implementations. In FIG. 5A, the mating interface includes a power terminal 501 and one or more data terminals 508. In some implementations, the mating interface is supported by a housing 505. In various implementations, the power terminal 501 is not flush with the housing 505 as indicated by distance 507 between the power terminal 501 and the housing 505 in FIG. 5A. In some implementations, the power terminal 501 and/or the one or more data terminals 508 are electrically isolated from the housing 505. In some implementations, the mating interface includes a support member (e.g., rubber or metal) to maintain the arrangement of the one or more data terminals 508 with the power terminal 501.

In some implementations, the power terminal 501 provides a respective mating interface between a power transmission path of the unified power and data cable (e.g., the power transmission path 320 in FIG. 3A) and a corresponding device power port (e.g., associated with one of the inter-switch ports 222 in FIG. 2A). The power terminal 501 includes a power portion 502 coupled to the power layer of the power transmission path (e.g., the power layer 322 in FIG. 3A), a dielectric portion 504 coupled to the dielectric layer of the power transmission path (e.g., the dielectric layer 324 in FIG. 3A), and a ground portion 506 coupled to the ground layer of the power transmission path (e.g., the ground layer 326 in FIG. 3A). In some implementations, the dielectric portion 504 of the power terminal 501 is located between the power portion 502 and the ground portion 506. In some implementations, at a least portion of the power portion 502 and/or the ground portion 506 are conductive flanges or plates that protrude outward from the mating interface of the connector 500 in order to couple to the device power port. In some implementations, the dielectric portion 504 is a dielectric layer between the power portion 502 and the ground portion 506 that does not couple to the device power port.

In some implementations, the one or more data terminals 508 each provide a respective mating interface between data lines of the data transmission path of the unified power and data cable (e.g., the data lines 312 in FIG. 3A) and a device data port (e.g., associated with one of the inter-switch ports 222 in FIG. 2A). One of ordinary skill in the art will appreciate that, in FIG. 5A, the one or more data terminals 508 correspond to an arbitrary number of data lines of the data transmission path of the unified power and data cable.

According to some implementations, the ground portion 506 is arranged in association with the one or more data terminals 508 in order to shield the one or more data terminals 508 from electromagnetic interference emanating from the power portion 502. For example, the power layer of the unified power and data cable causes electromagnetic interference that corrupts packet traffic on the data transmission path during high frequency events such as powering on a network switch or delivering power to a failed/disabled network switch. For example, in FIG. 5A, the ground portion 506 of the power terminal 501 is proximate to the one or more data terminals 508 in order to shield the one or more data terminals from the power portion 502 of the power terminal 501.

In some implementations, the one or more data terminals 508 are collocated in a respective plane that corresponds to a transverse axis of the connector 500. In some implementations, the ground portion 506 resides in a plane that is parallel and proximate to the respective plane in which the one or more data terminals 508 reside. In some implementations, the power portion 502, the dielectric portion 504, and the ground portion 506 reside in offset parallel planes as shown in FIG. 5A.

Figure 5B:
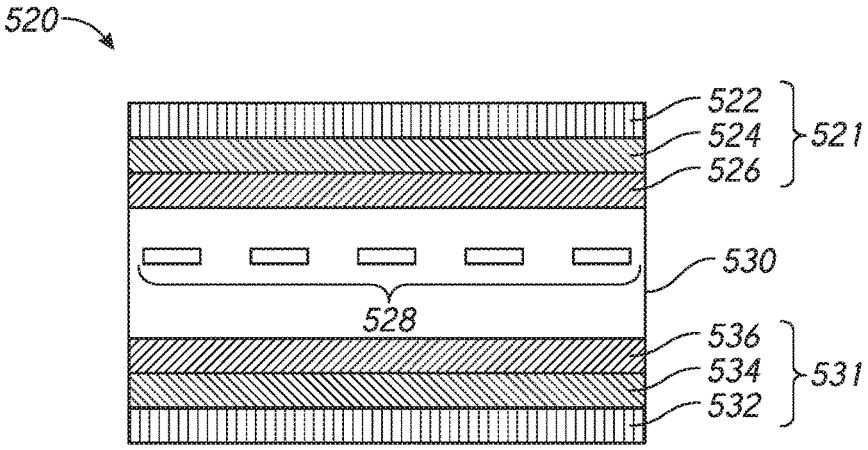
FIG. 5B is another end view of a mating interface of a connector for a unified power and data cable in accordance with some implementations.

FIG. 5B is another end view of a mating interface of a connector 520 for a unified power and data cable in accordance with some implementations. In FIG. 5B, the mating interface includes a first power terminal 521, a second power terminal 531, and one or more data terminals 528. In some implementations, the mating interface includes a support member (e.g., rubber or metal) to maintain the arrangement of the one or more data terminals 528 with the first and second power terminals 521, 531.

In some implementations, the first power terminal 521 and the second power terminal 531 form at least a portion of a housing 530 of the connector 520. In other implementations, the first power terminal 521 and the second power terminal 531 are flush with the housing 530 of the connector 520. Furthermore, in such implementations, the first power terminal 521 and the second power terminal 531 are electrically isolated from the housing 530 of the connector 520.

In some implementations, the first power terminal 521 provides a first mating interface between a first power transmission path of the unified power and data cable (e.g., the power transmission path 320 in FIG. 3A) and a corresponding device power port (e.g., associated with one of the inter-switch ports 222 in FIG. 2A). The first power terminal 521 includes a power portion 522 coupled to the power layer of the first power transmission path (e.g., the power layer 322 in FIG. 3A), a dielectric portion 524 coupled to the dielectric layer of the first power transmission path (e.g., the dielectric layer 324 in FIG. 3A), and a ground portion 526 coupled to the ground layer of the first power transmission path (e.g., the ground layer 326 in FIG. 3A). In some implementations, the dielectric portion 524 of the first power terminal 521 is located between the power portion 522 and the ground portion 526. In some implementations, at a least portion of the power portion 522 and/or the ground portion 526 are conductive flanges or plates that protrude outward from the mating interface of the connector 520 in order to couple to the device power port. In some implementations, the dielectric portion 524 is a dielectric layer between the power portion 522 and the ground portion 526 that does not couple to the device power port.

In some implementations, the second power terminal 531 provides a second mating interface between the first power transmission path of the unified power and data cable (e.g., the power transmission path 320 in FIG. 3A) and a corresponding device power port (e.g., associated with one of the inter-switch ports 222 in FIG. 2A). For example, the first power transmission path is spliced so that the layers of the first power transmission cable are connected to both the first power terminal 521 and the second power terminal 531. As such, the second power terminal 531 includes a power portion 532 coupled to the power layer of the first power transmission path (e.g., the power layer 322 in FIG. 3A), a dielectric portion 534 coupled to the dielectric layer of the power transmission path (e.g., the dielectric layer 324 in FIG. 3A), and a ground portion 536 coupled to the ground layer of the power transmission path (e.g., the ground layer 326 in FIG. 3A). In some implementations, the dielectric portion 534 of the second power terminal 531 is located between the power portion 532 and the ground portion 536. In some implementations, at a least portion of the power portion 532 and/or the ground portion 536 are conductive flanges or plates that protrude outward from the mating interface of the connector 520 in order to couple to the device power port. In some implementations, the dielectric portion 534 is a dielectric layer between the power portion 532 and the ground portion 536 that does not couple to the device power port.

In other implementations, the second power terminal 531 provides a mating interface between a second power transmission path of the unified power and data cable (e.g., the second power transmission path 380 in FIG. 3B) and a corresponding device power port (e.g., associated with one of the inter-switch ports 222 in FIG. 2A). For example, the unified power and data cable includes two power transmission paths as shown in FIG. 3B. As such, the second power terminal 531 includes a power portion 532 coupled to the power layer of the second power transmission path (e.g., the power $layer_2$ 382 in FIG. 3B), a dielectric portion 534 coupled to the dielectric layer of the power transmission path (e.g., the dielectric $layer_2$ 384 in FIG. 3B), and a ground portion 536 coupled to the ground layer of the power transmission path (e.g., the ground $layer_2$ 386 in FIG. 3B). In some implementations, the dielectric portion 534 of the second power terminal 531 is located between the power portion 532 and the ground portion 536. In some implementations, the power portion 532 and the ground portion 526 are conductive platelets. In some implementations, the power portion 532 and the ground portion 536 are conductive platelets. In some implementations, the dielectric portion 534 is a dielectric layer between the power portion 532 and the ground portion 536 that does not couple to the device power port.

In some implementations, the one or more data terminals 528 each provide a respective mating interface between data lines of the data transmission path of the unified power and data cable (e.g., the data lines 312 in FIG. 3A, or the data lines 362 in FIG. 3B) and a device data port (e.g., associated with one of the inter-switch ports 222 in FIG. 2A). One of ordinary skill in the art will appreciate that, in FIG. 5B, the one or more data terminals 528 correspond to an arbitrary number of data lines of the data transmission path of the unified power and data cable.

According to some implementations, the ground portions 526 and 536 are arranged in association with the one or more data terminals 528 in order to shield the one or more data terminals 508 from electromagnetic interference emanating from the power portions 522 and 532. For example, the power layer(s) of the unified power and data cable causes electromagnetic interference that corrupts packet traffic on the data transmission path during high frequency events such as powering on a network switch or delivering power to a failed/disabled network switch. For example, in FIG. 5B, the ground portion 526 of the first power terminal 521 and the ground portion 536 of the second power terminal 531 are proximate to the one or more data terminals 528 in order to shield the one or more data terminals 528 from the power portions 522 and 532.

In some implementations, the one or more data terminals 528 are collocated in a respective plane that corresponds to a transverse axis of the connector 520. In some implementations, the ground portions 526, 536 reside in planes that are parallel and proximate to the respective plane in which the one or more data terminals 528 reside. In some implementations, the power portion 522, the dielectric portion 524, and the ground portion 526 reside in offset parallel planes as shown in FIG. 5B. In some implementations, the power portion 532, the dielectric portion 534, and the ground portion 536 reside in offset parallel planes as shown in FIG. 5B.

Figure 5C:
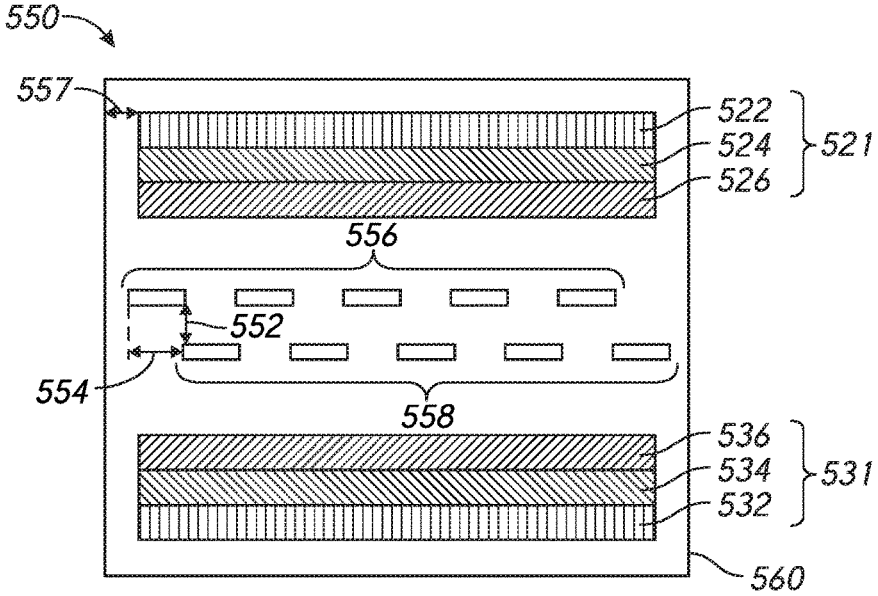
FIG. 5C is yet another end view of a mating interface of a connector for a unified power and data cable in accordance with some implementations.

FIG. 5C is yet another end view of a mating interface of a connector 550 for a unified power and data cable in accordance with some implementations. In FIG. 5C, the components of the mating interface of the connector 550 are similar to and adapted from those discussed above with reference to the connector 520 in FIG. 5B. Elements common to FIGS. 5B and 5C include common reference numbers, and only the differences between FIGS. 5B and 5C are described herein for the sake of brevity. With respect to FIG. 5C, the mating interface is enclosed by a housing 560. In various implementations, the first power terminal 521 and the second power terminal 531 are not flush with the housing 560 as indicated by distance 557 between the first power terminal 521 and the housing 560 in FIG. 5C. In some implementations, at least one of the first power terminal 521, the second power terminal 531, and the one or more data terminals 528 are electrically isolated from the housing 560.

In some implementations, the connector 550 includes a first set of one or more data terminals 556 and a second set of one or more data terminals 558 as shown in FIG. 5C. In some implementations, a distance 552 separates the first set of one or more data terminals 556 and the second set of one or more data terminals 558. In some implementations, the first set of one or more data terminals 556 are offset from the second set of one or more data terminals 558 by a distance 554. For example, the distances 552 and 554 are set to satisfy a predefined crosstalk criterion (e.g., less than X dB interference) between the first set of one or more data terminals 556 and the second set of one or more data terminals 558.

Figure 6A:
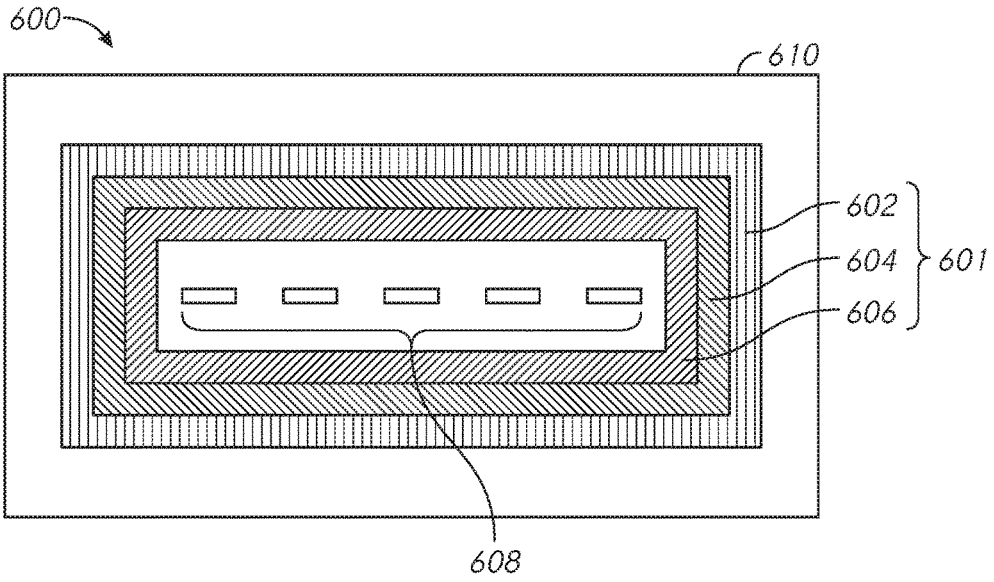
FIG. 6A is an end view of a mating interface of a connector for a unified power and data cable in accordance with some implementations.

FIG. 6A is an end view of a mating interface of a connector 600 for a unified power and data cable in accordance with some implementations. In FIG. 6A, the mating interface includes a power terminal 601 and one or more data terminals 608. In some implementations, the mating interface is enclosed by a housing 610. In some implementations, the power terminal 601 and/or the one or more data terminals 608 are electrically isolated from the housing 610. In some implementations, the mating interface includes a support member (e.g., rubber or metal) to maintain the arrangement of the one or more data terminals 608 with the power terminal 601.

In some implementations, the power terminal 601 provides a respective mating interface between a power transmission path of the unified power and data cable (e.g., the power transmission path 320 in FIG. 3A) and a corresponding device power port (e.g., associated with one of the inter-switch ports 222 in FIG. 2A). The power terminal 601 includes a power portion 602 coupled to the power layer of the power transmission path (e.g., the power layer 322 in FIG. 3A), a dielectric portion 604 coupled to the dielectric layer of the power transmission path (e.g., the dielectric layer 324 in FIG. 3A), and a ground portion 606 coupled to the ground layer of the power transmission path (e.g., the ground layer 326 in FIG. 3A). In some implementations, the dielectric portion 604 of the power terminal 601 is located between the power portion 602 and the ground portion 606. In some implementations, at a least portion of the power portion 602 and/or the ground portion 606 are conductive flanges or plates that protrude outward from the mating interface of the connector 600 in order to couple to the device power port. In some implementations, the dielectric portion 604 is a dielectric layer between the power portion 602 and the ground portion 606 that does not couple to the device power port.

In some implementations, the one or more data terminals 608 each provide a respective mating interface between data lines of the data transmission path of the unified power and data cable (e.g., the data lines 312 in FIG. 3A) and a device data port (e.g., associated with one of the inter-switch ports 222 in FIG. 2A). One of ordinary skill in the art will appreciate that, in FIG. 6A, the one or more data terminals 608 correspond to an arbitrary number of data lines of the data transmission path of the unified power and data cable.

According to some implementations, the ground portion 606 is arranged in association with the one or more data terminals 608 in order to shield the one or more data terminals 608 from electromagnetic interference emanating from the power portion 602. For example, the power layer of the unified power and data cable causes electromagnetic interference that corrupts packet traffic on the data transmission path during high frequency events such as powering on a network switch or delivering power to a failed/disabled network switch. For example, in FIG. 6A, the ground portion 606 of the power terminal 601 is proximate to and surrounds the one or more data terminals 608 in order to shield the one or more data terminals 608 from the power portion 602 of the power terminal 601. In some implementations, the power portion 602, the dielectric portion 604, and the ground portion 606 of the power terminal 601 have closed rectangular cross-sections. As such, in FIG. 6A, the one or more data terminals 608 are arranged within the inner perimeter of the rectangular cross-section of the ground portion 606 of the power terminal 601.

Figure 6B:
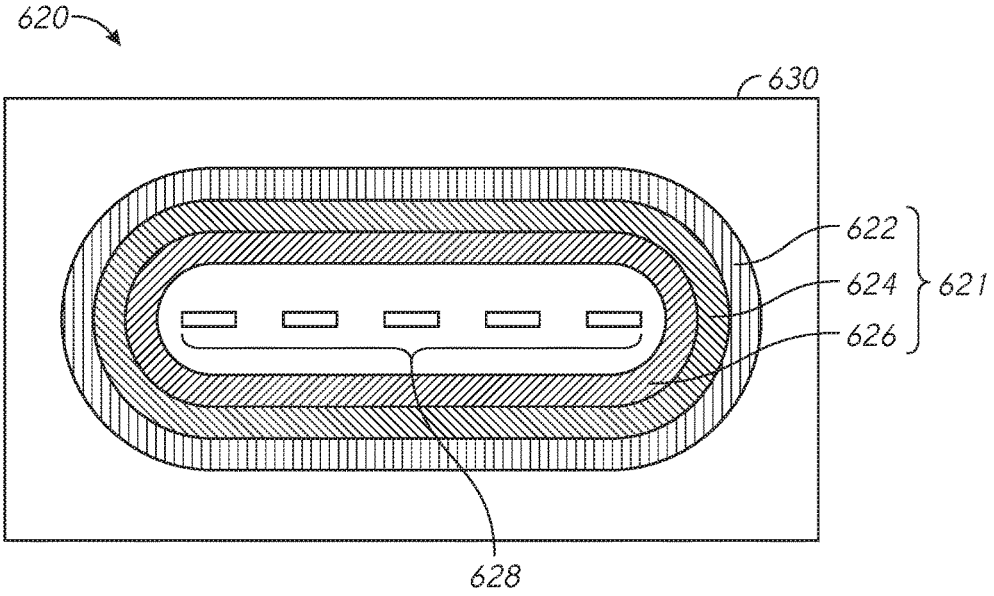
FIG. 6B is another end view of a mating interface of a connector for a unified power and data cable in accordance with some implementations.

FIG. 6B is another end view of a mating interface of a connector 620 for a unified power and data cable in accordance with some implementations. In FIG. 6B, the mating interface includes a power terminal 621 and one or more data terminals 628. In some implementations, the mating interface is enclosed by a housing 630. In some implementations, the power terminal 621 and/or the one or more data terminals 628 are electrically isolated from the housing 630. In FIG. 6B, according to some implementations, the components of the mating interface of connector 620 are adapted from those discussed above with reference to connector 600 in FIG. 6A and are not described again in detail for the sake of brevity.

In FIG. 6B, the ground portion 626 of the power terminal 621 is proximate to and surrounds the one or more data terminals 628. In some implementations, the power portion 622, the dielectric portion 624, and the ground portion 626 of the power terminal 621 have closed elliptical cross-sections. As such, in FIG. 6B, the one or more data terminals 628 are arranged within the inner perimeter of the elliptical cross-section of the ground portion 626 of the power terminal 621.

Figure 7A:
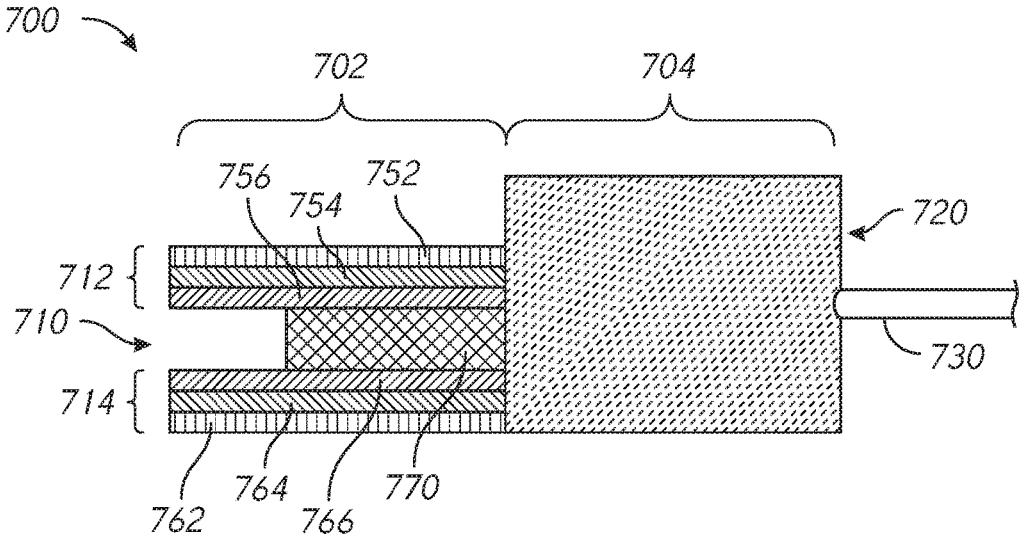
FIG. 7A is a side view along the length of a mating interface of a connector for a unified power and data cable in accordance with some implementations.
Figure 7B:
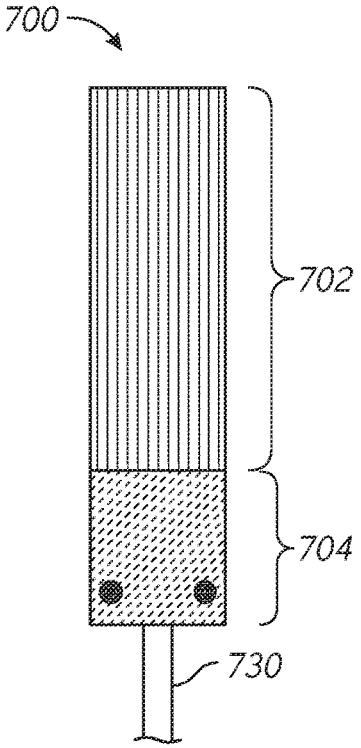
FIG. 7B is a top-down view of a first side of the connector in FIG. 7A in accordance with some implementations.
Figure 7C:
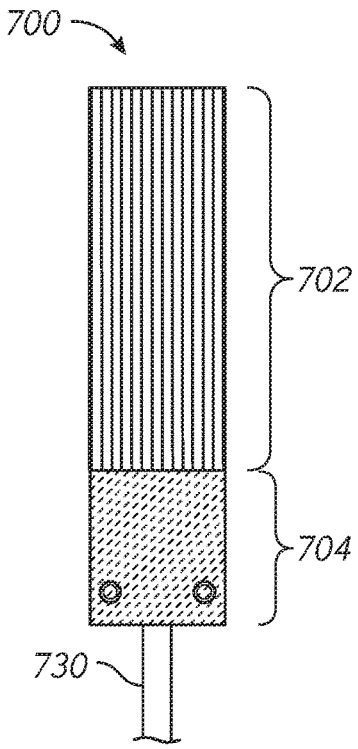
FIG. 7C is a top-down view of a second side of the connector in FIG. 7A in accordance with some implementations.

FIG. 7A is a side view along the length of a connector 700 for a unified power and data cable in accordance with some implementations. FIG. 7B is a top-down view of a first side of the connector 700 in FIG. 7A in accordance with some implementations. FIG. 7C is a top-down view of a second side of the connector 700 in FIG. 7A in accordance with some implementations. The connector 700 includes a first interface 720 (e.g., the translating interface) configured to receive a unified power and data cable 730 and to translate the geometry of the unified power and data cable to the geometry of a second interface 710. The connector 700 also includes a second interface 710 (e.g., a mating interface) connectable to a port of a device (e.g., one of the inter-switch ports 222 of the device 112 in FIG. 2A). In accordance with some implementations, a first portion 702 of the connector 700 is configured to mate with a port of the device. For example, the first portion 702 is configured for insertion into a cavity provided by the port of the device. In another example, the first portion 702 is configured to accept a protruding mating interface provided by the port of the device. In some implementations, the first portion 702 is conductive. In some implementations, a second portion 704 of the connector 700 is insulated and electrically isolated from the first portion 702.

In some implementations, the first interface 710 includes flanges 712, 714 (e.g., lips) arranged to ensure a secure mechanical connection with the port of the device. For example, the flange 712 corresponds to the first power terminal 521 in FIGS. 5B and 5C, and the flange 714 corresponds to the second power terminal 531 in FIGS. 5B and 5C. With reference to FIG. 7A, the flange 712 comprises a power layer 752, a ground layer 756, and a dielectric layer 754 located between the power layer 752 and the ground layer 756. Similarly, the flange 714 comprises a power layer 762, a ground layer 766, and a dielectric layer 764 located between the power layer 762 and the ground layer 766. With reference to FIG. 7A, one or more data lines 770 are located between the ground layer 756 of the flange 712 and the ground layer 766 of the flange 714. As such, the one or more data lines 770 are shielded by the ground layers 756 and 766 from electromagnetic interference emanating from the power layers 752 and 762.

In some implementations, at least a portion of the flanges 712 and 714 are electrified when delivering power to and/or from the device (e.g., the power layers 752 and 762). In some implementations, the flanges 712 and 714 are electrically isolated from the second portion 704.

Figure 8:
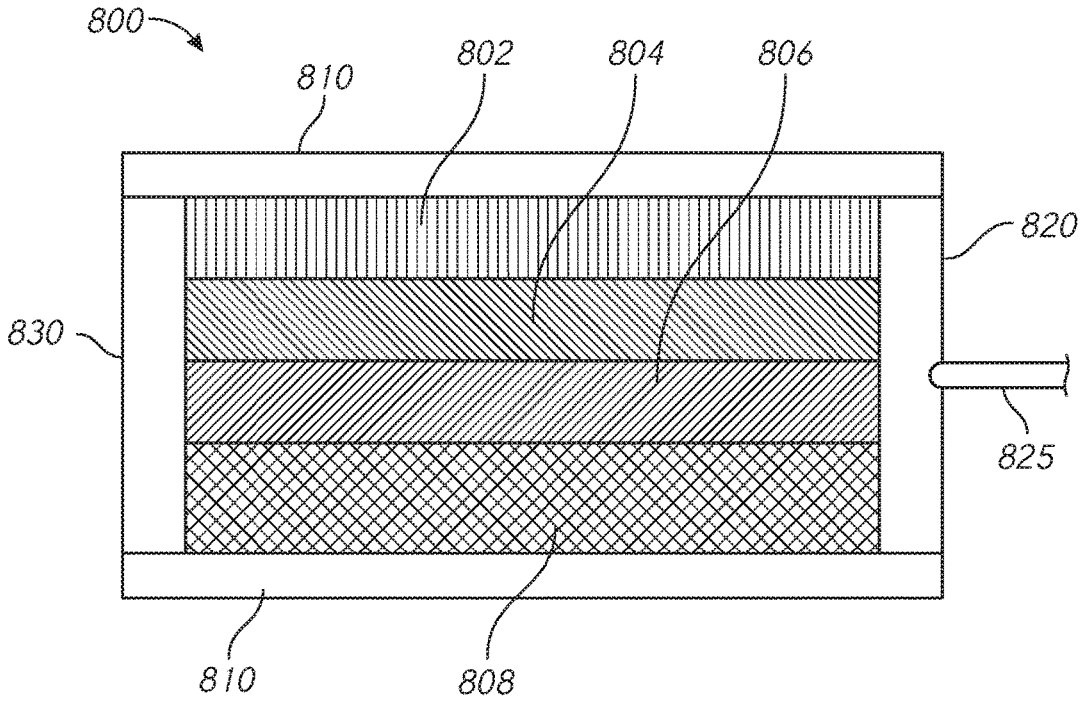
FIG. 8 is a simplified cross-section view along the length of a connector for a unified power and data cable in accordance with some implementations.

FIG. 8 is a simplified cross-section view along the length of a connector 800 for a unified power and data cable in accordance with some implementations. The connector 800 includes a first interface 820 (e.g., a translating interface) configured to receive a unified power and data cable 825 (e.g., one of the cables 220 in FIG. 2A) having a data transmission path (e.g., with one or more data lines) and at least one power transmission path sheathing the data transmission path. The connector also includes the second interface 830 (e.g., a mating interface) connectable to a port of a device (e.g., one of the inter-switch ports 222 of the device 112 in FIG. 2A). In some implementations, a housing 810 at least partially encloses the components of the connector 800.

In some implementations, the first interface 820 is configured to separate the layers of the unified power and data cable 825 within the body of the connector 800 as shown in FIG. 8. As such, the first interface 820 translates the geometry of the unified power and data cable (e.g., circular layers) to the geometry of the second interface 830 (e.g., the geometry of the mating interface in FIG. 5A, 6A, or 6B). In FIG. 8, the dielectric layer 804 of the power transmission path is located between the power layer 802 and the ground layer 806 of the power transmission path (e.g., similar to the layers of the power terminal 501 in FIG. 5A). The ground layer 806 is located proximate to the one or more data lines 808 of the data transmission path in order to shield the one or more data lines 808 from electromagnetic interference caused by the power layer 802.

Figure 9A:
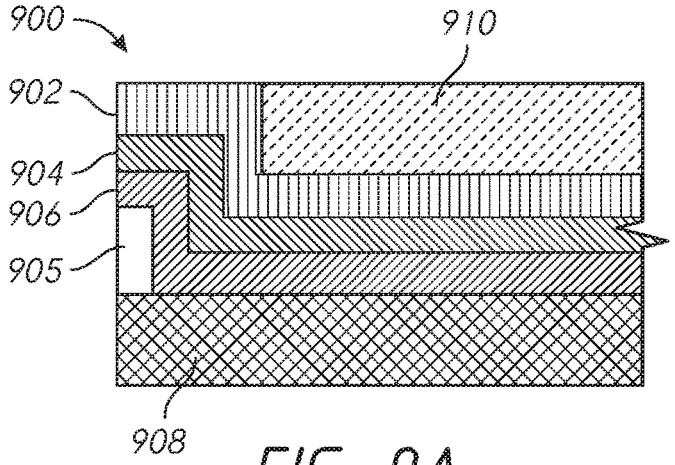
FIG. 9A is a simplified cross-section view of a connector for a unified power and data cable in accordance with some implementations.

FIG. 9A is a simplified cross-section view of a connector 900 for the unified power and data cable in accordance with some implementations. In some implementations, the connector 900 includes a first interface (not shown) (e.g., a translating interface) configured to receive a unified power and data cable having a data transmission path with one or more data lines and at least one power transmission path sheathing the data transmission path. The first interface is also configured to translate the geometry of the unified power and data cable to the geometry of a second interface (not shown) (e.g., a mating interface).

FIG. 9A shows a respective schematic view of the layers of the unified power and data cable within the body of the connector 900 after being translated by the first interface. With reference to FIG. 9A, a dielectric layer 904 of the power transmission path is located between a power layer 902 and a ground layer 906 of the power transmission path. In some implementations, the ground layer 906 of the power transmission path is located proximate to at least a portion of the one or more data lines 908 of the data transmission path in order to shield the one or more data lines 908 from electromagnetic interference caused by the power layer 902. In some implementations, a gap 905 is located between at least a portion of the ground layer 906 and the one or more data lines 908.

In some implementations, the connector 900 includes an insulator 910 that is proximate and parallel to at least a portion of the power layer 902. As such, at least a portion of the connector 900 is insulated and isolated from the power layer 902. In one example, an installer of the unified power and data cable is protected from electrocution as only the portion of the connector that is inserted into the port of the device is electrified (e.g., the second interface and optionally a portion of the housing up to the insulator 910 such as the flange 712 in FIG. 7A). In some implementations, a portion of the power layer 902 forms a portion of the housing of the connector 900 along with the insulator 910. In some implementations, at least a portion of the power layer 902 is flush with a housing of the connector 900 and electrically isolated from the housing.

Figure 9B:
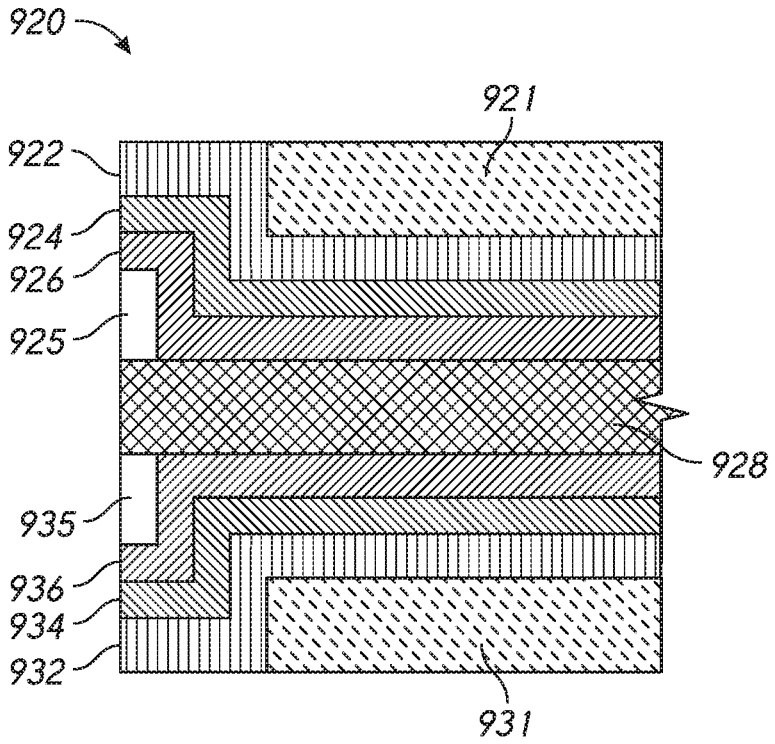
FIG. 9B is another simplified cross-section view of a connector for a unified power and data cable in accordance with some implementations.

FIG. 9B is another simplified cross-section view of a connector 920 for a unified power and data cable in accordance with some implementations. In some implementations, the connector 920 includes a first interface (not shown) (e.g., a translating interface) configured to receive a unified power and data cable having a data transmission path with one or more data lines and two power transmission paths sheathing the data transmission path. The first interface is also configured to translate the geometry of the unified power and data cable to the geometry of a second interface (not shown) (e.g., a mating interface).

FIG. 9B shows a respective schematic view of the layers of the unified power and data cable within the body of the connector 920 after being translated by the first interface. With reference to FIG. 9B, a dielectric layer 924 of a first power transmission path is located between a power layer 922 and a ground layer 926 of the first power transmission path. In some implementations, the ground layer 926 of the first power transmission path is located proximate to at least a portion of the one or more data lines 928 of the data transmission path in order to shield the one or more data lines 928 from electromagnetic interference caused by the power layer 922. In some implementations, a gap 925 is located between at least a portion of the ground layer 926 and the one or more data lines 928.

A dielectric layer 934 of a second power transmission path is located between a power layer 932 and a ground layer 936 of the second power transmission path. In some implementations, the ground layer 936 of the second power transmission path is located proximate to at least a portion of the one or more data lines 928 of the data transmission path in order to shield the one or more data lines 928 from electromagnetic interference caused by the power layer 932. In some implementations, a gap 935 is located between at least a portion of the ground layer 936 and the one or more data lines 928.

In some implementations, the connector 920 includes an insulator 921 that is proximate and parallel to at least a portion of the power layer 922 of the first power transmission path. As such, at least a portion of the connector 920 is insulated and isolated from the power layer 922 of the first power transmission path. In some implementations, the connector 920 also includes an insulator 931 that is proximate and parallel to at least a portion of the power layer 932 of the second power transmission path. As such, at least a portion of the connector 920 is similarly insulated and isolated from the power layer 932 of the second power transmission path. In one example, an installer of the unified power and data cable is protected from electrocution as only the portion of the connector that is inserted into the port of the device is electrified (e.g., the second interface and optionally a portion of the housing up to the insulators 921 and 931 such as the flanges 712, 714 in FIG. 7A). In some implementations, a portion of the power layers 922 and 932 form a portion of the housing of the connector 920 along with the insulators 921, 931. In some implementations, at least a portion of the power layers 922 and 932 are flush with a housing of the connector 920 and electrically isolated from the housing.

Figure 9C:
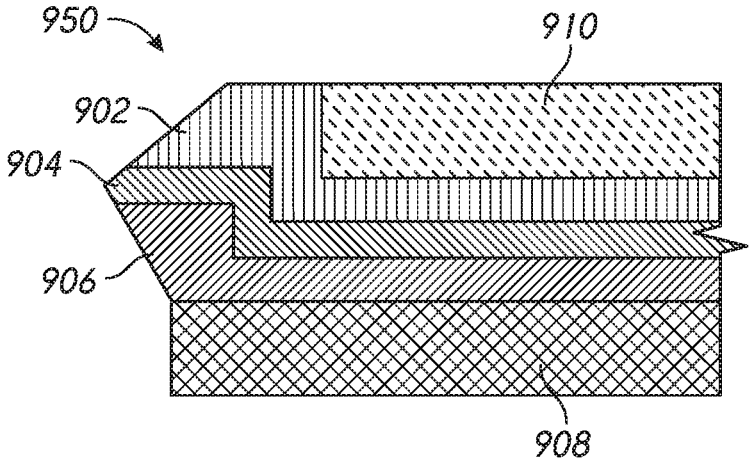
FIG. 9C is yet another simplified cross-section view of a connector for a unified power and data cable in accordance with some implementations.

FIG. 9C is yet another simplified cross-section view of a connector 950 for a unified power and data cable in accordance with some implementations. In some implementations, the connector 950 includes a first interface (not shown) (e.g., a translating interface) configured to receive a unified power and data cable having a data transmission path with one or more data lines and two power transmission paths sheathing the data transmission path. The first interface is also configured to translate the geometry of the unified power and data cable to the geometry of a second interface (not shown) (e.g., a mating interface).

FIG. 9C shows a respective schematic view of the layers of the unified power and data cable within the body of the connector 950 after being translated by the first interface. The layers of the unified power and data cable are similar to and adapted from those discussed above with reference to the connector 900 in FIG. 9A. Elements common to FIGS. 9A and 9C include common reference numbers, and only the differences between FIGS. 9A and 9C are described herein for the sake of brevity. In the respective geometric configuration, a least a portion of the power transmission path (e.g., including the power layer 902, the dielectric layer, 904, and the ground layer 906) is angled, as shown in FIG. 9C, to couple with an angled power terminal of the mating interface. In some implementations, the power terminal of the mating interface is one of a chamfered edge, a rounded edge, a tapered edge, and the like in order to satisfy mating criteria in association with the corresponding device power port. In some implementations, he data transmission path (e.g., the one or more data lines 908) is not angled, as shown in FIG. 9C. In some implementations, the one or more data terminals of the mating interface optionally include one of a chamfered edge, a rounded edge, a tapered edge, and the like in order to satisfy mating criteria in association with the corresponding device data port. For example, the angled mating interface ensures a secure mechanical connection with the device power and/or data ports.

Figure 10A:
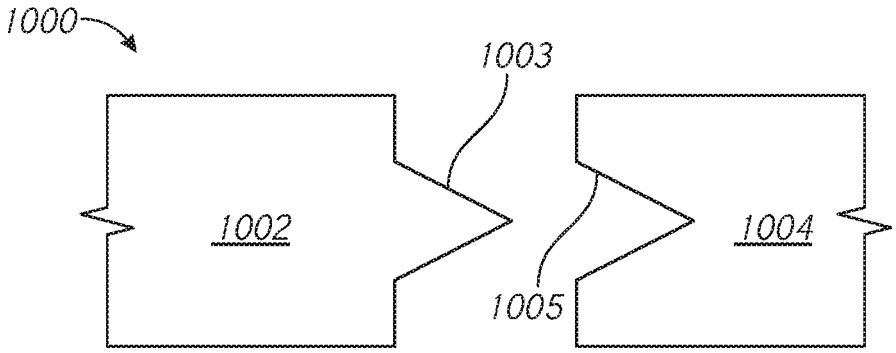
FIG. 10A is a side-view of a mating configuration in accordance with some implementations.

FIG. 10A is a side-view of a mating configuration 1000 in accordance with some implementations. According to the mating configuration 1000, a protruding edge 1003 of a connector body 1002 is connectable with a sunken edge 1005 of a port 1004 of a device (e.g., one of the inter-switch ports 222 of a networking switch 112 in FIG. 2A). For example, the protruding edge 1003 of the connector body 1002 ensures a secure mechanical connection with the port 1004. In some implementations, at least one of the one or more power terminals and the one or more data terminals of the mating interface of a connector associated with the connector body 1002 has a triangular protruding cross-section as shown in FIG. 10A.

Figure 10B:
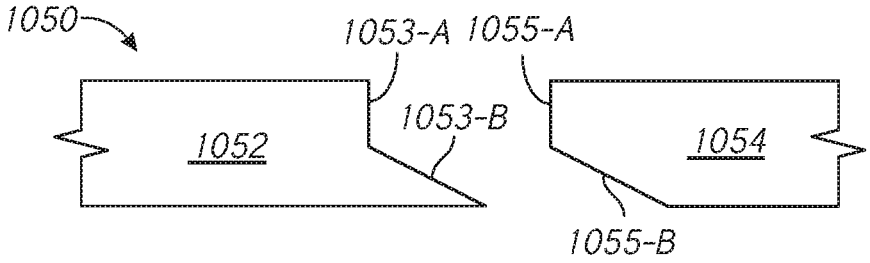
FIG. 10B is another side-view of a mating configuration in accordance with some implementations.

FIG. 10B is another side-view of a mating configuration 1050 in accordance with some implementations. In some implementations, a connector body 1052 is connectable with port a 1054 of a device (e.g., one of the inter-switch ports 222 of a networking switch 112 in FIG. 2A). According to the mating configuration 1050, the connector body 1052 has a first edge 1053-A and a second edge 1053-B. For example, the first edge 1053-A is flat (e.g., 90°), and the second edge 1053-B is at least X° (e.g., X is 22.5°) but not more than Y° (e.g., Y is 45°). According to some implementations, one of ordinary skill in the art will appreciate that the angles of first and second edges of the connector body 1052 can be swapped or changed to accommodate various other configurations. As such, the port 1054 has a first edge 1055-A for receiving the first edge 1053-A of the connector body 1052, and a second edge 1055-B for receiving the second edge 1053-B of the connector body 1052. For example, the first and second edges 1053-A, 1053-B of the connector body 1052 ensure a secure mechanical connection with the port 1054. In some implementations, at least one of the one or more power terminals and the one or more data terminals of the mating interface of a connector associated with the connector body 1052 has a first edge with a flat cross-section and a second edge with a tapered cross-section as shown in FIG. 10B.

Figure 11:
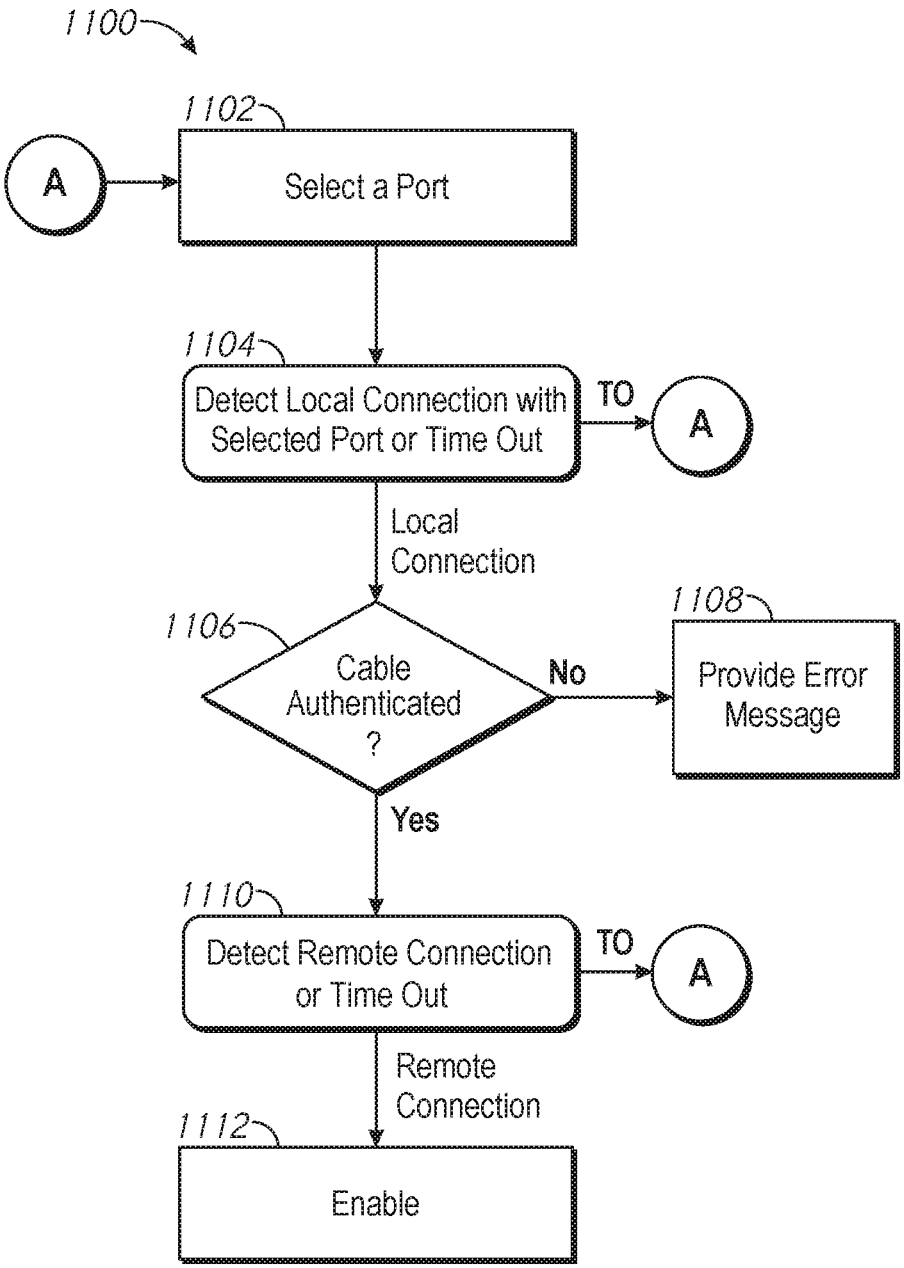
FIG. 11 is a flowchart representation of a method of authenticating a cable in accordance with some implementations.

FIG. 11 is a flowchart representation of a method 1100 of authenticating a cable in accordance with some implementations. In some implementations, at least a portion of the method 1100 is performed by a controller of a first device such as the controller 230 of the networking switching 112-1 in FIG. 2B. In some implementations, at least a portion of the method 1100 is performed by a controller of a cable such as the controller 430 in FIG. 4. In some implementations, the controller of the cable is located in a first connector terminating a first end (e.g., the near end) of the cable. For example, with reference to FIG. 2A, the first connector of the cable 220-1 (not shown) is coupled with one of the inter-switch ports 222-1 of the networking switch 112-1 in FIG. 2A. In some implementations, the method 1100 is performed by processing logic, including a suitable combination of hardware, firmware, and software. In some implementations, the method 1100 is performed by a processor executing encoded instructions stored in a non-transitory computer-readable medium (e.g., a memory). Briefly, the method 1100 includes detecting a local connection between a first device (e.g., a first networking switch) and a cable (e.g., a unified power and data cable), authenticating the cable coupled to the first device, detecting a remote connection between the cable and a second device (e.g., a second networking switch), and enabling the cable to deliver power to and/or from the first second device.

To that end, as indicated by block 1102, the method 1100 includes selecting a port. For example, with reference to FIG. 2B, the controller 112-1 selects the port 224 (e.g., one of one or more inter-switch ports 222-1 in FIG. 2A). For example, with reference to FIG. 2B, the controller 112-1 pseudo-randomly selects the port 224. For example, with reference to FIG. 2B, the controller 112-1 selects the port 224 based on a predefined pattern. For example, with reference to FIG. 2B, the controller 112-1 selects the port 224 according to the most frequently used ports.

As indicated by block 1104, the method 1100 includes determining whether a local connection between a first device and a cable (e.g., the unified power and data cable 220-1 in FIGS. 2A-2B) at the selected port is detected within a predefined time out period. For example, with reference to FIG. 2B, the controller 230 of the networking switch 112-1 polls the port 224 using a low-speed interface to determine whether the cable 220-1 is coupled to the port 224. In another example, with reference to FIG. 4, the controller 430 detects that a first end the cable terminated by the connector 400 is coupled to a first device. If a local connection is detected within the predefined time out period ("Local Connection" path from block 1104), the method 1100 proceeds to block 1106. If a local connection is not detected within the predefined time out period ("TO" path from block 1104), the method 1100 repeats block 1102.

As indicated by block 1106, the method 1100 includes determining whether the cable satisfies authentication criteria. For example, with reference to FIG. 2B, the controller 230 of the networking switch 112-1 obtains authentication information from the cable 220-1 by reading the memory of the cable 220-1 (e.g., the memory 450 in FIG. 4). In another example, with reference to FIG. 4, the controller 430 of the cable (e.g., the cable 220-1 in FIGS. 2A-2B) provides authentication information to the device to which it is coupled in response to being polled by the device (e.g., networking device 112-1 in FIGS. 2A-2B) or independent of the polling process. For example, the authentication information indicates the cable's manufacturing date, manufacturer, and serial number.

For example, the authentication criteria are satisfied if the authentication information indicates that the cable is manufactured by or associated with a predefined manufacturer or distributer. In another example, the authentication criteria are satisfied if the authentication information indicates that the cable is associated with a serial number that satisfies predefined criteria (e.g., the serial number is within a range of serial numbers or the serial number is included in a list of compatible serial numbers).

In some implementations, after authenticating the cable, one or more compatible features of the cable are identified. In some implementations, as part of the cable authentication process, the one or more compatible features of the cable are identified. For example, the authentication information indicates compatible features, electrical specification and tolerances, and the like, along with the manufacturing date, the manufacturer's name, and the serial number.

If the cable is authenticated ("Yes" path from block 1106), the method 1100 proceeds to block 1110. If the cable is not authenticated ("No" path from block 1106), the method 1100 proceeds to block 1108.

As indicated by block 1108, the method 1100 includes providing an error or warning message to the owner and/or operator of first device. For example, the error or warning message indicates that the cable coupled to the first device is incompatible and could potentially damage the first device. In another example, the error or warning message indicates that the cable coupled to the first device is inauthentic (e.g., a knock-off cable) and/or does not satisfy the authentication criteria.

As indicated by block 1110, the method 1100 includes determining whether a remote connection between the cable and a second device is detected within a predefined time out period. For example, the second device is coupled to the opposite or far end of the cable as opposed to the first device. For example, with reference to FIG. 2B, the controller 230 of the networking switch 112-1 determines whether the cable 220-1 is coupled with a second device (e.g., the networking switch 112-2 in FIG. 2B) and determines whether the second device is a compatible device using the high-speed data interface. In another example, with reference to FIG. 2B, the controller 230 of the networking switch 112-1 determines whether the cable 220-1 is coupled with a second device (e.g., the networking switch 112-2 in FIG. 2B) and determines whether the second device is a compatible device by accessing cloud-based data. For example, the cloud-based data indicates that the networking switch 112-2 is coupled with a cable that has a same serial number (e.g., the cable 220-1). In another example, with reference to FIG. 4, the controller 430 determines whether a second device is coupled to a second end (e.g., the far end) of the cable opposite the connector 400 and whether the second device is a compatible device using a high-speed data interface.

If a remote connection is detected within the predefined time out period ("Remote Connection" path from block 1110), the method 1100 proceeds to block 1112. If a remote connection is not detected within the predefined time out period ("TO" path from block 1110), the method 1100 repeats block 1102.

As indicated by block 1112, the method 1100 includes enabling the cable to deliver power to and/or from the first device. For example, with reference to FIG. 2B, the controller 230 of the networking switch 112-1 activates the logic controlled switch 232 in order to enable the PSU 206-1 to deliver power to the second device (e.g., the networking switch 112-2 in FIG. 2B) via the cable 220-1. In another example, the controller 230 in FIG. 2B of the networking switch 112-1 sends an enable signal to the controller 430 in FIG. 4, which, in turn, electrifies at least a portion of the connector 400 (e.g., the flanges 712 and 714 in FIG. 7A). In yet another example, with reference to FIG. 4, the controller 430 of the cable (e.g., the cable 220-1 in FIGS. 2A-2B) activates the logic controlled switch 442 in order to enable the delivery of power to and/or from the first device (e.g., the networking switch 112-1 in FIG. 2B) coupled to the one or more power terminals 424.

In some implementations, the method 1100 is concurrently performed by a controller of the second device (e.g., the networking switch 112-2 in FIGS. 2A and 2B). In some implementations, the method 1100 is concurrently performed by a controller of the cable located in a second connector terminating a second end (e.g., the far end) of the cable (e.g., the second connector of the cable 220-1 is coupled with one of the inter-switch ports 222-2 of the networking switch 112-2 in FIG. 2A).

In some implementations, the method 1100 is performed by the controller of the second device before the controller of the first device and/or a controller of the cable located in a first connector terminating a first end (e.g., the near end) of the cable performs the method 1100. In some implementations, the method 1100 is performed by the controller of the cable located in the second connector terminating the second end of the cable before the controller of the first device and/or a controller of the cable located in a first connector terminating a first end (e.g., the near end) of the cable performs the method 1100.

In some implementations, the method 1100 is performed by the controller of the second device after the controller of the first device and/or the controller of the cable located in the first connector terminating the first of the cable performs the method 1100. In some implementations, the method 1100 is performed by the controller of the cable located in the second connector terminating the second end of the cable after the controller of the first device and/or the controller of the cable located in the first connector terminating the first of the cable performs the method 1100.

Briefly, as performed by the controller of the second device and/or the controller of the cable located in the second connector terminating the second end of the cable, the method 1100 also includes detecting a local connection between a second device (e.g., a second networking switch) and a cable (e.g., a unified power and data cable), authenticating the cable coupled to the second device, detecting a remote connection between the cable and a first device (e.g., a first networking switch), and enabling the cable to deliver power to and/or from the second device.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first layer could be termed a second layer, and, similarly, a second layer could be termed a first layer, which changing the meaning of the description, so long as all occurrences of the "first layer" are renamed consistently and all occurrences of the "second layer" are renamed consistently. The first layer and the second layer are both layers, but they are not the same layer.

The terminology used herein is for the purpose of describing particular embodiments only and is not intended to be limiting of the claims. As used in the description of the embodiments and the appended claims, the singular forms "a", "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. A device comprising:

a plurality of data terminals, wherein each of the plurality of data terminals provides a respective mating interface between a respective data transmission path and a corresponding device data port, the plurality of data terminals including at least three data terminals arranged in a first plane characterized by a transverse axis of the device;

a first power terminal having a power portion and a ground portion separated by a dielectric portion, wherein the ground portion is at least partially disposed in a second plane parallel to the first plane between the power portion and the plurality of data terminals in order to shield the plurality of data terminals from electromagnetic interference from the power portion, and wherein the first power terminal provides a respective mating interface between a respective power transmission path and a corresponding device power port; and a support member provided to maintain the arrangement of the plurality of data terminals and the first power terminal.

2. The device of claim 1, wherein the ground portion is at least partially disposed in a third plane that is parallel to the first plane between the power portion and the plurality of data terminals, the third plane being on an opposite side of the data terminals as the second plane.

3. The device of claim 1, wherein the ground portion surrounds the plurality of data terminals.

4. The device of claim 3, wherein the power portion surrounds the ground portion.

5. The device of claim 3, wherein the ground portion has a closed cross-section having a first dimension along the transverse axis and a second dimension perpendicular to the transverse axis, the first dimension being greater than the second dimension.

6. The device of claim 1, further comprising:

a translating interface configured to receive a cable comprising the respective data transmission path and the respective power transmission path and configured to couple the data transmission path to the one or more data terminals and the power transmission path to the first power terminal.

7. The device of claim 6, further comprising:

a second power terminal, wherein the receiving interface is further configured to couple the respective power transmission path to the second power terminal in addition to the first power terminal.

8. The device of claim 6, further comprising:

a second power terminal, wherein the receiving interface is further configured to couple a second power transmission path of the cable to the second power terminal.

9. The device of claim 6, wherein the power portion terminates a first distance away from the translating interface, the ground portion terminates a second distance away from the translating interface, and the dielectric portion terminates a third distance away from the translating interface, the third distance being greater than the first distance and being greater than the second distance.

10. The device of claim 6, wherein the power terminal comprises two flanges arranged to ensure a secure mechanical connection with the device power port, the flanges terminating a first distance away from the translating interface, wherein the data terminal terminates a second distance away from the translating interface, the second distance being less than the first distance.

11. The device of claim 1, wherein at least a portion of the first power terminal includes one of a chamfered, a rounded, and a tapered edge in order to satisfy mating criteria in association with the corresponding device power port.

12. The device of claim 1, the plurality of data terminals further including at least three data terminals arranged in a second plane parallel to the first plane and arranged offset from the at least three data terminals arranged in the first plane.

13. An apparatus comprising:

a cable having a data transmission path disposed about an axial center of the cable and a power transmission path sheathing the data transmission path;

a first connector configured to terminate a first end of the cable and to mate with a port of a first device; and a second connector configured to terminate a second end of the cable and to mate with a port of a second device, wherein the first and second connectors include:

a plurality of data terminals, wherein each of the plurality of data terminals provides a respective mating interface between the data transmission path and a corresponding device data port, the plurality of data terminals including at least three data terminals arranged in a first plane characterized by a transverse axis of the device;

a first power terminal having a power portion and a ground portion separated by a dielectric portion, wherein the ground portion is at least partially disposed in a second plane parallel to the first plane between the power portion and the plurality of one or more data terminals in order to shield the plurality of data terminals from electromagnetic interference from the power portion, and wherein the first power terminal provides a respective mating interface between the power transmission path and a corresponding device power port; and a support member provided to maintain the arrangement of the plurality of data terminals and the first power terminal.

14. The apparatus of claim 13, wherein the ground portion is at least partially disposed in a third plane that is parallel to the first plane between the power portion and the plurality of data terminals, the third plane being on an opposite side of the data terminals as the second plane.

15. The apparatus of claim 13, wherein the ground portion surrounds the plurality of data terminals.

16. The apparatus of claim 15, wherein the power portion surrounds the ground portion.

17. The apparatus of claim 15, wherein the ground layer has a closed cross-section having a first dimension along the transverse axis and a second dimension perpendicular to the transverse axis, the first dimension being greater than the second dimension.

18. The apparatus of claim 13, wherein the first and second connectors further include memory configured to authenticate the device.

19. The apparatus of claim 13, wherein the first and second connectors further include a controller configured to enable at least one of the first power terminal and the one or more data transmission terminals.

20. A method comprising:

coupling a first connector of a cable to a port of a first device and a second connector of the cable to a port of a second device, wherein the first and second connectors include:

a plurality of data terminals, wherein each of the plurality of data terminals provides a respective mating interface between the data transmission path and a corresponding device data port, the plurality of data terminals including at least three data terminals arranged in a first plane characterized by a transverse axis of the device;

a first power terminal having a power portion and a ground portion separated by a dielectric portion, wherein the ground portion is at least partially disposed in a second plane parallel to the first plane between the power portion and the plurality of one or more data terminals in order to shield the plurality of data terminals from electromagnetic interference from the power portion, and wherein the first power terminal provides a respective mating interface between the power transmission path and a corresponding device power port; and a support member provided to maintain the arrangement of the plurality of data terminals and the first power terminal;

providing power between the first device and the second device via the cable; and providing data between the first device and the second device via the cable.

* * * * *